US007695332B2

(12) United States Patent
Morikawa et al.

(10) Patent No.: US 7,695,332 B2
(45) Date of Patent: Apr. 13, 2010

(54) COAXIAL CABLE END-PROCESSING STRUCTURE, COAXIAL CABLE SHIELDING TERMINAL AND PRESS-FASTENING APPARATUS

(75) Inventors: Taishi Morikawa, Makinohara (JP); Tetsuro Ide, Makinohara (JP); Tadahisa Sakaguchi, Makinohara (JP); Nobuyuki Asakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 2 days.

(21) Appl. No.: 12/186,299

(22) Filed: Aug. 5, 2008

(65) Prior Publication Data

US 2009/0011663 A1 Jan. 8, 2009

Related U.S. Application Data

(62) Division of application No. 11/386,797, filed on Mar. 23, 2006, now Pat. No. 7,425,161.

(30) Foreign Application Priority Data

Mar. 23, 2005 (JP) ..... 2005-082994
Mar. 23, 2005 (JP) ..... 2005-083012

(51) Int. Cl.
*H01R 4/10* (2006.01)

(52) U.S. Cl. ..... 439/877; 439/92; 439/98; 439/578; 439/585; 174/84 C

(58) Field of Classification Search ..... 439/92, 439/98, 99, 100, 578–585, 874, 877, 885; 174/74 R, 75 C, 78, 84 R, 84 C
See application file for complete search history.

(56) References Cited

U.S. PATENT DOCUMENTS

| | | | | |
|---|---|---|---|---|
| 2,678,963 A | | 5/1954 | Everhart | |
| 3,032,602 A | | 5/1962 | Farnell | |
| 3,051,773 A | | 8/1962 | Batcheller | |
| 3,517,375 A | | 6/1970 | Mancini | |
| 4,697,339 A | * | 10/1987 | Verhoeven | 29/828 |

(Continued)

FOREIGN PATENT DOCUMENTS

| | | |
|---|---|---|
| DE | 198 50 883 A1 | 6/1999 |
| DE | 100 21 294 A1 | 11/2000 |
| JP | S61-110977 A | 5/1986 |

(Continued)

OTHER PUBLICATIONS

Japanese Office Action dated Nov. 9, 2009 issued in application No. P2005-82994.

*Primary Examiner*—James Harvey
(74) *Attorney, Agent, or Firm*—Sughrue Mion, PLLC

(57) ABSTRACT

An intermediate portion of an insulating sheath of a coaxial cable is removed, and a first insulating sheath portion is drawn toward a second insulating sheath portion, so that a braid is projected into an annular shape outwardly from an interval between opposed ends of the first and second insulating sheath portions to form an annular projecting braid portion, and this annular projecting braid portion is fixed so as to be connected to a portion (that is, a braid fixing portion) of a coaxial cable shielding terminal for connection to an end portion of the coaxial cable. This connecting and fixing operation is effected by press-contacting or press-clamping.

8 Claims, 21 Drawing Sheets

U.S. PATENT DOCUMENTS

| | | | | |
|---|---|---|---|---|
| 4,754,636 | A | 7/1988 | Kautz et al. | |
| 5,607,325 | A * | 3/1997 | Toma | 439/578 |
| 5,664,967 | A | 9/1997 | Hatagishi et al. | |
| 5,711,686 | A * | 1/1998 | O'Sullivan et al. | 439/610 |
| 5,718,607 | A * | 2/1998 | Murphy et al. | 439/610 |
| 5,725,387 | A * | 3/1998 | O'Sullivan et al. | 439/98 |
| 5,785,555 | A * | 7/1998 | O'Sullivan et al. | 439/610 |
| 5,823,825 | A * | 10/1998 | Murphy | 439/610 |
| 5,997,335 | A | 12/1999 | Kameyama et al. | |
| 6,244,901 | B1 | 6/2001 | Fujii et al. | |
| 6,332,807 | B1 * | 12/2001 | Asakura et al. | 439/578 |
| 6,517,392 | B2 | 2/2003 | Murakami et al. | |
| 7,425,161 | B2 * | 9/2008 | Morikawa et al. | 439/877 |
| 2006/0216998 | A1 * | 9/2006 | Morikawa et al. | 439/610 |
| 2009/0011663 | A1 * | 1/2009 | Morikawa et al. | 439/877 |
| 2009/0035991 | A1 * | 2/2009 | Sakaguchi et al. | 439/585 |

FOREIGN PATENT DOCUMENTS

| | | | |
|---|---|---|---|
| JP | H04-23081 | U | 2/1992 |
| JP | H04-136875 | U | 12/1992 |
| JP | 6-314577 | A | 11/1994 |
| JP | 7-320799 | A | 12/1995 |
| JP | 8-45575 | A | 2/1996 |
| JP | 10-92488 | A | 4/1998 |
| JP | 2000-102133 | A | 4/2000 |
| JP | 103 15 042 | A1 | 10/2003 |
| JP | 2004-55475 | A | 2/2004 |

* cited by examiner

COAXIAL CABLE END-PROCESSING STRUCTURE, COAXIAL CABLE SHIELDING TERMINAL AND PRESS-FASTENING APPARATUS

This is a divisional of application Ser. No. 11/386,797, now U.S. Pat. No. 7,425,161, filed Mar. 23, 2006. The entire disclosure of the prior application Ser. No. 11/386,797 is incorporated by reference.

BACKGROUND OF THE INVENTION

1. Field of the Invention

This invention relates to a coaxial cable end-processing structure, a coaxial cable shielding terminal forming a coaxial connector, and a press-fastening apparatus having a press clamping-purpose press-fastening blade for press-deforming a press-clamping portion of a coaxial cable shielding terminal.

2. Related Art

Generally, a coaxial cable, used for transmitting high-frequency signals as in an antenna wire, comprises, in radially outward sequence, a core conductor serving as a center conductor, an insulator serving as a dielectric, a metallic tape conductor and a braid (which serve as an outer conductor), and an insulating sheath serving as an outer covering. The coaxial cable of this construction has a coaxial connector provided at an end thereof, and the coaxial cable can be connected to a mating equipment, a mating coaxial cable or the like via this coaxial connector. The coaxial connector includes a coaxial cable shielding terminal through which the braid is connected to a mating coaxial connector for grounding purposes so as to intercept electrical noises such as electromagnetic waves and static electricity.

The following connecting structure of connecting a coaxial cable to a coaxial connector has been proposed. Namely, a braid is exposed at an end portion of the coaxial cable, and the exposed braid is undone or unloosed, and then a connecting conductor portion of the coaxial connector is inserted into an interval between the undone braid and a metallic tape conductor (or an insulator) disposed inside this braid. Then, a metallic sleeve, separate from the coaxial cable and the coaxial connector, is press-fastened onto the exposed braid. By thus press-fastening the metallic sleeve, the coaxial cable is electrically and mechanically connected to the coaxial connector (see, for example, Japanese Patent Publication No. JP-A-2004-55475 (Pages 4 to 5, FIGS. 1 to 4)).

In this connecting structure, the connecting conductor portion of the coaxial connector is inserted into the interval between the braid and the metallic tape conductor (or the insulator) in order to prevent the contours of transverse cross-sections of the insulator and the outer conductor from being deformed out of concentric relation to each other, that is to say, in order to satisfy high-frequency characteristics. This connecting structure is also configured to satisfy a predetermined tensile strength of the coaxial cable and the coaxial connector.

In the above conventional technique, it is necessary to carry out the operation for undoing the braid, exposed at the end portion of the coaxial cable, in order that the connecting conductor portion of the coaxial connector can be inserted into the inside of the braid of the coaxial cable. Therefore, the conventional connecting structure has a problem that the efficiency of the operation is affected since the cumbersome operation must be carried out. And besides, in the above conventional technique, the metallic sleeve, separate from the coaxial cable and the coaxial connector, is prepared, and is mounted on the coaxial cable, and therefore it is necessary to produce the metallic sleeve and to effect its mounting operation. Therefore, the conventional connecting structure has problems that the number of the component parts increases and that the efficiency of the operation is affected.

SUMMARY OF THE INVENTION

This invention has been made in view of the above circumstances, and an object of the invention is to provide a coaxial cable end-processing structure and a coaxial cable shielding terminal, in which an operation can be easily carried out, and the number of component parts is reduced, and high-frequency characteristics and a tensile strength can be maintained. Another object is to provide a press-fastening apparatus useful for the coaxial cable end-processing structure and the coaxial cable shielding terminal.

(1) The above object has been achieved by a coaxial cable end-processing structure of the invention wherein an intermediate portion of an insulating sheath of a coaxial cable is removed, and a first insulating sheath portion is drawn toward a second insulating sheath portion, so that a braid is projected into an annular shape outwardly from an interval between opposed ends of the first and second insulating sheath portions to form an annular projecting braid portion, and the annular projecting braid portion is fixed so as to be connected to a portion of a coaxial cable shielding terminal for connection to an end portion of the coaxial cable.

In the invention having the above features, the annular projecting braid portion, formed at the coaxial cable, is fixed so as to be connected to the portion of the coaxial cable shielding terminal. In the invention, the annular projecting braid portion is not formed by an undone portion of the braid, and also a portion of the coaxial cable shielding terminal does not need to be inserted into the inside of the braid, and therefore the end processing operation can be easily carried out. And besides, in the invention, it is not necessary to use a metallic sleeve, and therefore the operation for processing the end portion of the coaxial cable can be effected with a reduced number of the component parts. Furthermore, in the invention, the contours of transverse cross-sections of an insulator and an outer conductor of the coaxial cable will not be deformed, and therefore high-frequency characteristics can be maintained. Furthermore, in the invention, the braid, covered with second insulating sheath portion, is not moved because of the structural nature, and therefore the coaxial cable shielding terminal, fixed so as to be connected to the annular projecting braid portion, will not be displaced relative to the coaxial cable, and as a result a tensile strength can be maintained.

(2) The coaxial cable end-processing structure of the invention is further characterized in that the portion of the coaxial cable shielding terminal is configured to be fixed so as to be connected by press-contacting to the annular projecting braid portion.

In the invention having the above feature, the annular projecting braid portion is fixed so as to be connected to the portion of the coaxial cable shielding terminal by press-contacting. Press-contacting blades are formed at the portion of the coaxial cable shielding terminal, and the annular projecting braid portion is inserted into these press-contacting blades to be fixed so as to be connected thereto.

(3) The coaxial cable end-processing structure of the invention is further characterized in that the portion of the coaxial cable shielding terminal is configured to be fixed so as to be connected by press-clamping to the annular projecting braid portion such that the portion squeezes the annular projecting braid portion in a direction of a thickness thereof or in a radial direction thereof.

In the invention having the above feature, the annular projecting braid portion is fixed so as to be connected to the portion of the coaxial cable shielding terminal by press-clamping such that the annular projecting braid portion is squeezed in the direction of the thickness thereof or in the radial direction thereof. A press-clamping portion is formed at the portion of the coaxial cable shielding terminal, and the annular projecting braid portion is gripped by this press-clamping portion to be fixed so as to be connected thereto.

(4) The coaxial cable end-processing structure of the invention is further characterized in that the coaxial cable shielding terminal has an insulating sheath-holding portion formed at or in a vicinity of the portion thereof, and the insulating sheath-holding portion holds the second insulating sheath portion or both of the first and second insulating sheath portions.

In the invention having the above feature, the insulating sheath is supplementally held by the insulating sheath-holding portion, so that the tensile strength can be more positively maintained. In the coaxial cable end-processing structure of the invention, although the tensile strength is satisfied when the annular projecting braid portion, formed at the coaxial cable, is fixed so as to be connected to the portion of the coaxial cable shielding terminal, the tensile strength can be more positively maintained by holding the insulating sheath by the insulating sheath-holding portion. The insulating sheath-holding portion also serves to stabilize the condition of that portion of the annular projecting braid portion to which the shielding terminal is fixed so as to be connected.

(5) The above object has been achieved by a coaxial cable shielding terminal including a braid fixing portion, characterized in that the braid fixing portion is configured to be fixed so as to be connected by press-contacting or press-clamping to an annular projecting braid portion of a coaxial cable, the annular projecting braid portion being formed by removing an intermediate portion of an insulating sheath of the coaxial cable and by drawing a first insulating sheath portion toward a second insulating sheath portion, thereby causing a braid to project into an annular shape outwardly from an interval between opposed ends of the first and second insulating sheath portions.

In the invention having the above features, the shielding terminal has the braid fixing portion to which the annular projecting braid portion, formed at the coaxial cable, can be fixed so as to be connected. With the use of the coaxial cable shielding terminal of the invention, the braid does not need to be undone, and also a portion of the coaxial cable shielding terminal does not need to be inserted into the inside of the braid, and therefore the end processing operation can be easily carried out. And besides, in the invention, the contours of transverse cross-sections of the insulator and the outer conductor of the coaxial cable will not be deformed, and therefore the high-frequency characteristics can be maintained. Furthermore, in the invention, the braid, covered with the second insulating sheath portion, is not moved because of the structural nature, and therefore the coaxial cable shielding terminal, fixed so as to be connected to the annular projecting braid portion, will not be displaced relative to the coaxial cable, and as a result the tensile strength can be maintained.

(6) The coaxial cable shielding terminal of the invention is further characterized in that the coaxial cable shielding terminal has an insulating sheath-holding portion formed at or in a vicinity of the braid fixing portion, and the insulating sheath-holding portion is adapted to hold the second insulating sheath portion or both of the first and second insulating sheath portions.

In the invention having the above feature, the insulating sheath is supplementally held by the insulating sheath-holding portion, so that the tensile strength can be more positively maintained. In the invention, although the tensile strength is satisfied when the braid fixing portion is fixed so as to be connected to the annular projecting braid portion formed at the coaxial cable, the tensile strength can be more positively maintained by holding the insulating sheath by the insulating sheath-holding portion. The insulating sheath-holding portion also serves to stabilize the condition of that portion of the annular projecting braid portion to which the braid fixing portion is fixed so as to be connected.

(7) The above object has been achieved by a coaxial cable end-processing structure wherein a slit, extending in a direction generally perpendicular to a direction of extending of a coaxial cable, is formed in a press-clamping portion of a coaxial cable shielding terminal, and the press-clamping portion is press-deformed so as to decrease a width of the slit, thereby causing the slit to grip an insulating sheath of the coaxial cable and/or a braid of the coaxial cable exposed to the exterior of the insulating sheath.

In the invention having the above features, the width of the slit, formed in the press-clamping portion of the coaxial cable shielding terminal, is decreased, and at this time the insulating sheath and/or the braid, exposed to the exterior of the insulating sheath, is gripped by the slit. As a result, the coaxial cable is fixed so as to be connected to the coaxial cable shielding terminal. In the invention, the insulating sheath and/or the braid, exposed to the exterior of the insulating sheath, are gripped in the coaxial cable-extending direction, and therefore the contours of transverse cross-sections of an insulator and an outer conductor of the coaxial cable will not be deformed. As a result, high-frequency characteristics can be maintained. And besides, in the invention, since the insulating sheath and/or the braid, exposed to the exterior of the insulating sheath, are gripped, a tensile strength can be maintained. Furthermore, in the invention, it is not necessary to use a metallic sleeve, and therefore the operation for processing the end portion of the coaxial cable can be effected with a reduced number of component parts, and also the end processing operation can be easily carried out.

(8) The coaxial cable end-processing structure of the invention is further characterized in that an intermediate portion of the insulating sheath is removed, and a first insulating sheath portion is drawn toward a second insulating sheath portion, so that the braid is projected into an annular shape outwardly from an interval between opposed ends of the first and second insulating sheath portions to form an annular projecting braid portion, and the annular projecting braid portion is gripped by the slit.

In the invention having the above features, the annular projecting braid portion is formed at the coaxial cable, and this annular projecting braid portion is electrically and mechanically connected to the press-clamping portion having the slit.

(9) The above object has been achieved by a coaxial cable shielding terminal having a press-clamping portion, wherein the press-clamping portion has a slit extending in a direction generally perpendicular to a direction of extending of a coaxial cable, and the press-clamping portion can be press-deformed so as to decrease a width of the slit, thereby causing the slit to grip an insulating sheath of the coaxial cable and/or a braid of the coaxial cable exposed to the exterior of the insulating sheath.

In the invention having the above features, the insulating sheath of the coaxial cable and/or the braid of the coaxial cable, exposed to the exterior of the insulating sheath, are gripped by the slit in the press-clamping portion. During the press-deforming of the press-clamping portion, the width of the slit is decreased, and the insulating sheath and/or the braid, exposed to the exterior of the insulating sheath, are gripped by the slit. As a result, the coaxial cable is fixed so as to be connected to the coaxial cable shielding terminal. In the invention, the insulating sheath and/or the braid, exposed to the exterior of the insulating sheath, are gripped in the coaxial cable-extending direction, and therefore the contours of transverse cross-sections of the insulator and the outer conductor of the coaxial cable will not be deformed. As a result, the high-frequency characteristics can be maintained. And besides, in the invention, since the insulating sheath and/or the braid, exposed to the exterior of the insulating sheath, are gripped, the tensile strength can be maintained. Furthermore, in the invention, it is not necessary to use a metallic sleeve, and therefore the operation for processing the end portion of the coaxial cable can be effected with a reduced number of component parts, and also the end processing operation can be easily carried out.

(10) The coaxial cable shielding terminal of the invention is further characterized in that an intermediate portion of the insulating sheath is removed, and a first insulating sheath portion is drawn toward a second insulating sheath portion, so that the braid is projected into an annular shape outwardly from an interval between opposed ends of the first and second insulating sheath portions to form an annular projecting braid portion, and the annular projecting braid portion can be gripped by the slit.

In the invention having the above features, the annular projecting braid portion, formed at the coaxial cable, is electrically and mechanically connected to the press-clamping portion having the slit.

(11) The above object has been achieved by a press-fastening apparatus of the invention comprising a press clamping-purpose press-fastening blade having a press-clamping portion guide groove for guiding a press-clamping portion of a coaxial cable shielding terminal, wherein a width of the press-clamping portion guide groove between its opposed side surfaces is defined by tapering surfaces for decreasing a width of a slit which is formed in the press-clamping portion, and extends in a direction generally perpendicular to a direction of extending of the coaxial cable.

In the invention having the above features, during the process of press-deforming the press-clamping portion of the coaxial cable shielding terminal, the press-clamping portion is inserted into the press-clamping portion guide groove of the press clamping-purpose press-fastening blade, and is guided into the inside of this groove. The opposed side surfaces of the press-clamping portion guide groove for guiding the press-clamping portion are defined by the tapering surfaces, and therefore the width of the slit in the press-clamping portion is decreased by these tapering surfaces. When the width of the slit in the press-clamping portion is thus decreased, the insulating sheath and/or the braid, exposed to the exterior of the insulating sheath, are gripped by the slit, and the coaxial cable is fixed so as to be connected to the coaxial cable shielding terminal.

In the invention according to (1), there is achieved an advantage that there can be provided the coaxial cable end-processing structure in which the operation can be easily carried out, and besides the number of the component parts is reduced, and furthermore the high-frequency characteristics and the tensile strength can be maintained.

In the invention according to (2), the annular projecting braid portion is connected by press-contacting to the portion of the coaxial cable shielding terminal to be fixed thereto, and by doing so, there are achieved advantages that the efficiency of the operation is enhanced as compared with the conventional structure, that the number of the component parts is reduced and that the high-frequency characteristics and the tensile strength can be maintained.

In the invention according to (3), the annular projecting braid portion is connected by press-clamping to the portion of the coaxial cable shielding terminal to be fixed thereto, and by doing so, there are achieved advantages that the efficiency of the operation is enhanced as compared with the conventional structure, that the number of the component parts is reduced and that the high-frequency characteristics and the tensile strength can be maintained.

In the invention according to (4), by providing the insulating sheath-holding portion, there is achieved an advantage that the tensile strength can be more positively maintained.

In the invention according to (5), there is achieved an advantage that there can be provided the coaxial cable shielding terminal in which the operation can be easily carried out, and besides the number of the component parts is reduced, and furthermore the high-frequency characteristics and the tensile strength can be maintained.

In the invention according to (6), by providing the insulating sheath-holding portion, there is achieved an advantage that the tensile strength can be more positively maintained.

In the invention according to (7), there is achieved an advantage that there can be provided the coaxial cable end-processing structure in which the operation can be easily carried out, and besides the number of the component parts is reduced, and furthermore the high-frequency characteristics and the tensile strength can be maintained.

In the invention according to (8), there is achieved an advantage that the annular projecting braid portion can easily be electrically and mechanically connected to the coaxial cable shielding terminal.

In the invention according to (9), there is achieved an advantage that there can be provided the coaxial cable shielding terminal in which the operation can be easily carried out, and besides the number of the component parts is reduced, and furthermore the high-frequency characteristics and the tensile strength can be maintained.

In the invention according to (10), there is achieved an advantage that the annular projecting braid portion can easily be electrically and mechanically connected to the coaxial cable shielding terminal.

In the invention according to (11), there is achieved an advantage that there can be provided the press-fastening apparatus useful for the coaxial cable end-processing structure and the coaxial cable shielding terminal.

BRIEF DESCRIPTION OF THE DRAWINGS

FIG. 1A is a perspective view showing a condition before a connecting operation is effected, and FIG. 1B is a cross-sectional view showing a condition after the connecting operation is effected.

DETAILED DESCRIPTION OF THE PREFERRED EMBODIMENTS

The present invention will now be described with reference to the drawings.

First Embodiment

Figure 1B:
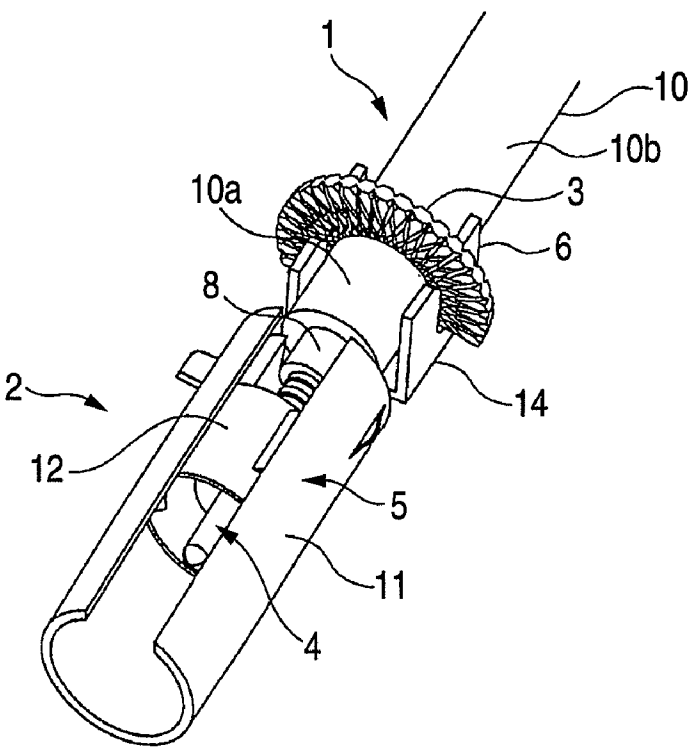
FIGS. 1A and 1B show a coaxial cable end-processing structure and a coaxial cable shielding terminal which are provided in accordance with a first embodiment of the invention.
Figure 1A:
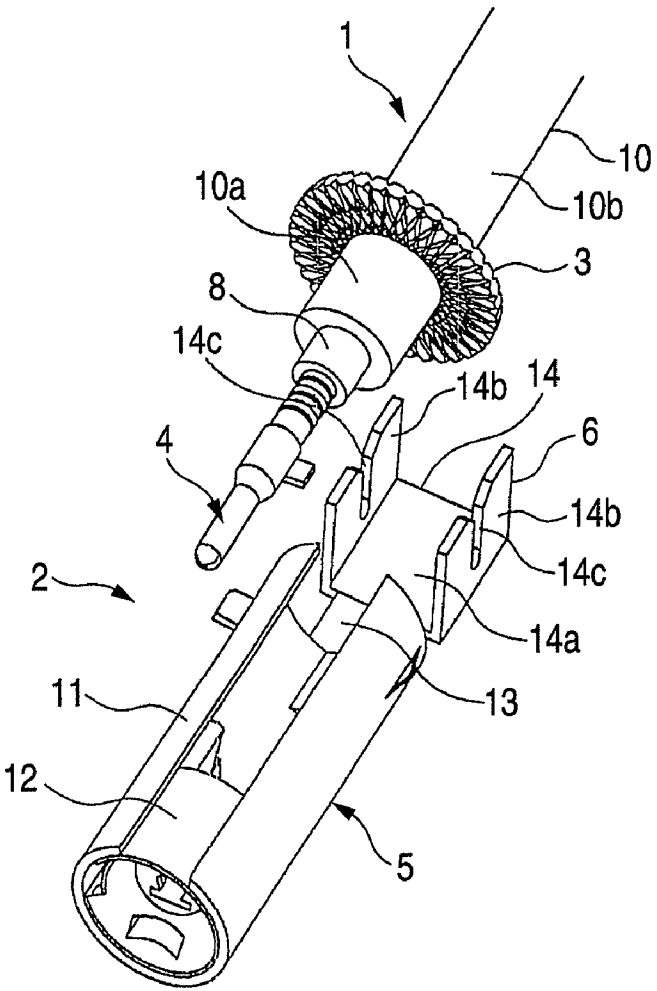
Figure 2:
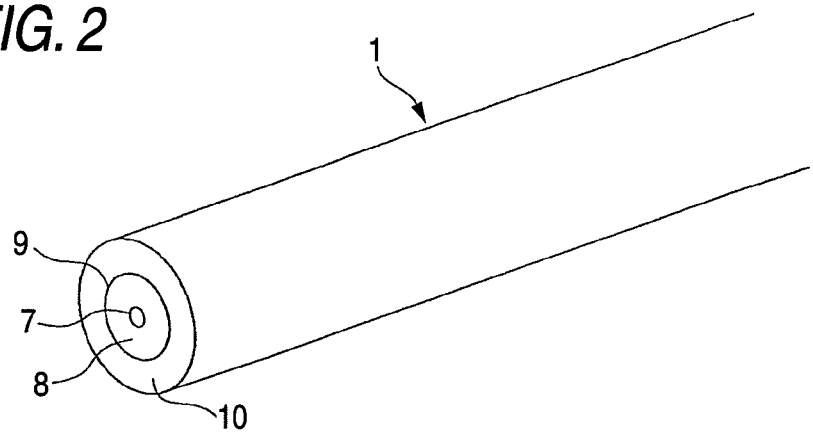
FIG. 2 is a perspective view of a coaxial cable which is not yet processed.
Figure 3:
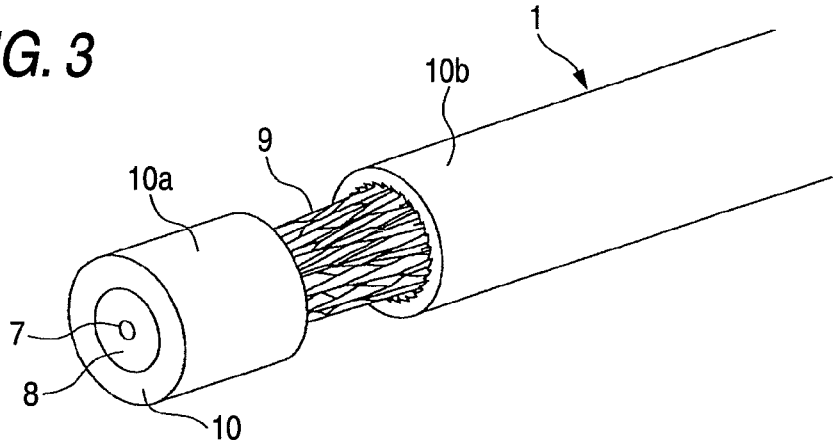
FIG. 3 is a perspective view of the coaxial cable, showing a condition in which an intermediate portion of an insulating sheath of the coaxial cable is removed.
Figure 4:
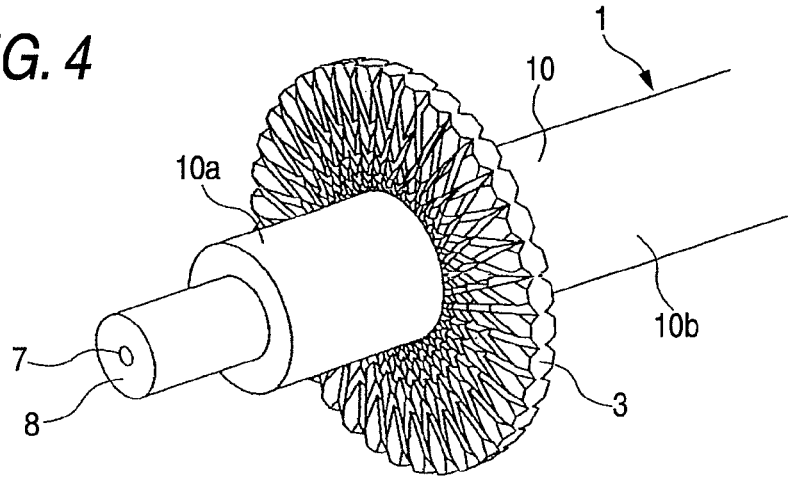
FIG. 4 is a perspective view of the coaxial cable, showing a condition in which an annular projecting braid portion is formed on the coaxial cable.
Figure 5:
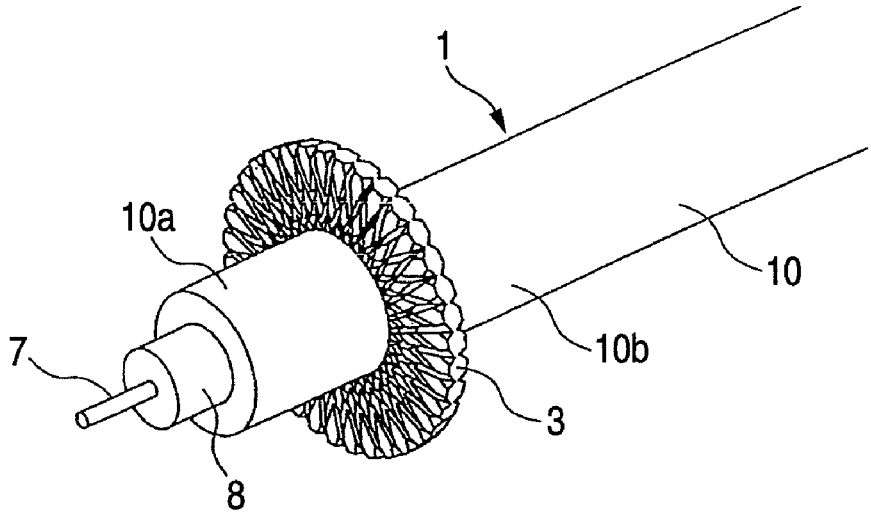
FIG. 5 is a perspective view showing a condition in which a core conductor is exposed.
Figure 6:
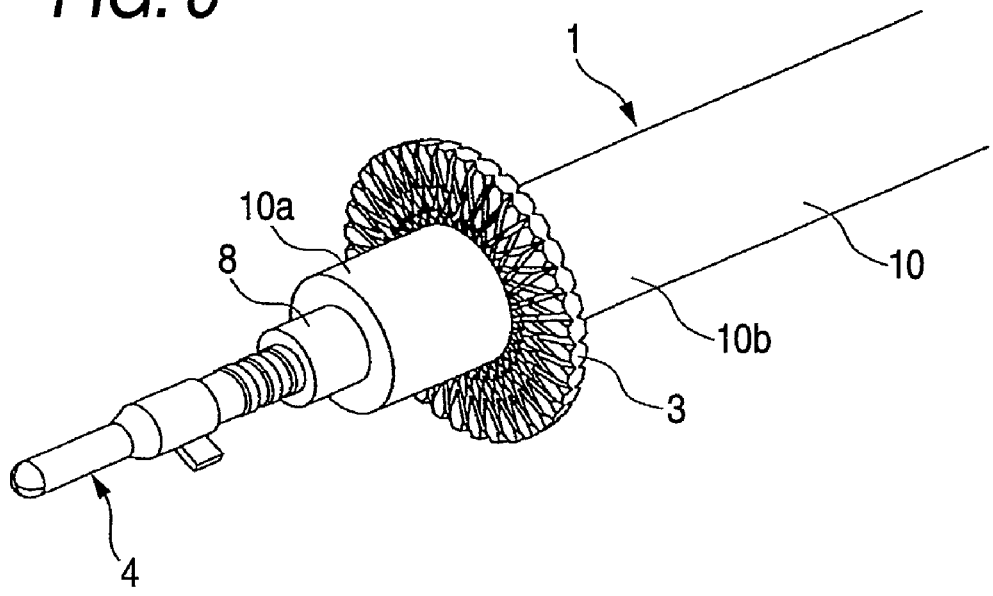
FIG. 6 is a perspective view showing a condition in which an inner terminal is mounted on a core conductor.
Figure 7:
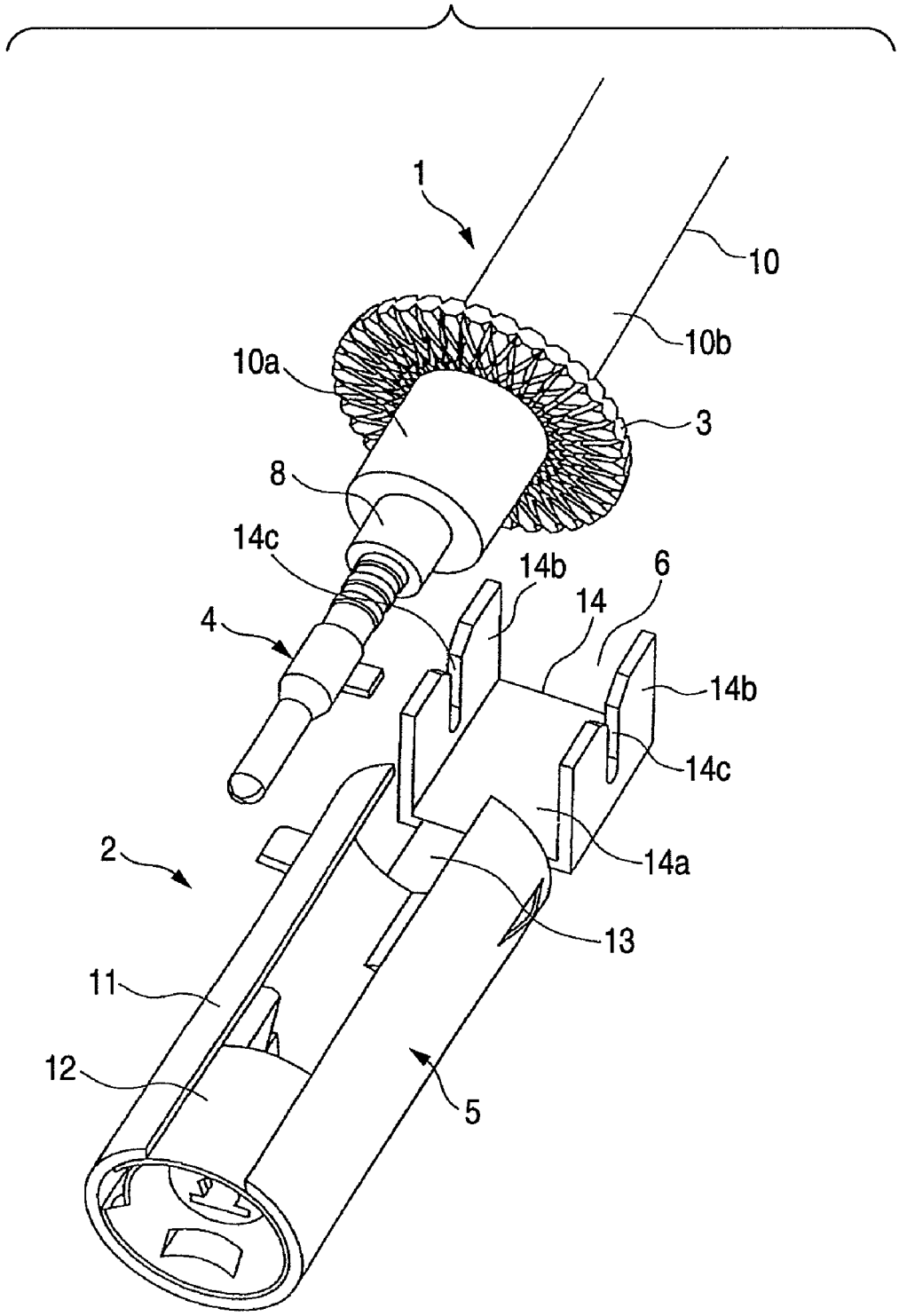
FIG. 7 is a perspective view showing a condition before the coaxial cable is connected to the coaxial cable shielding terminal.
Figure 8:
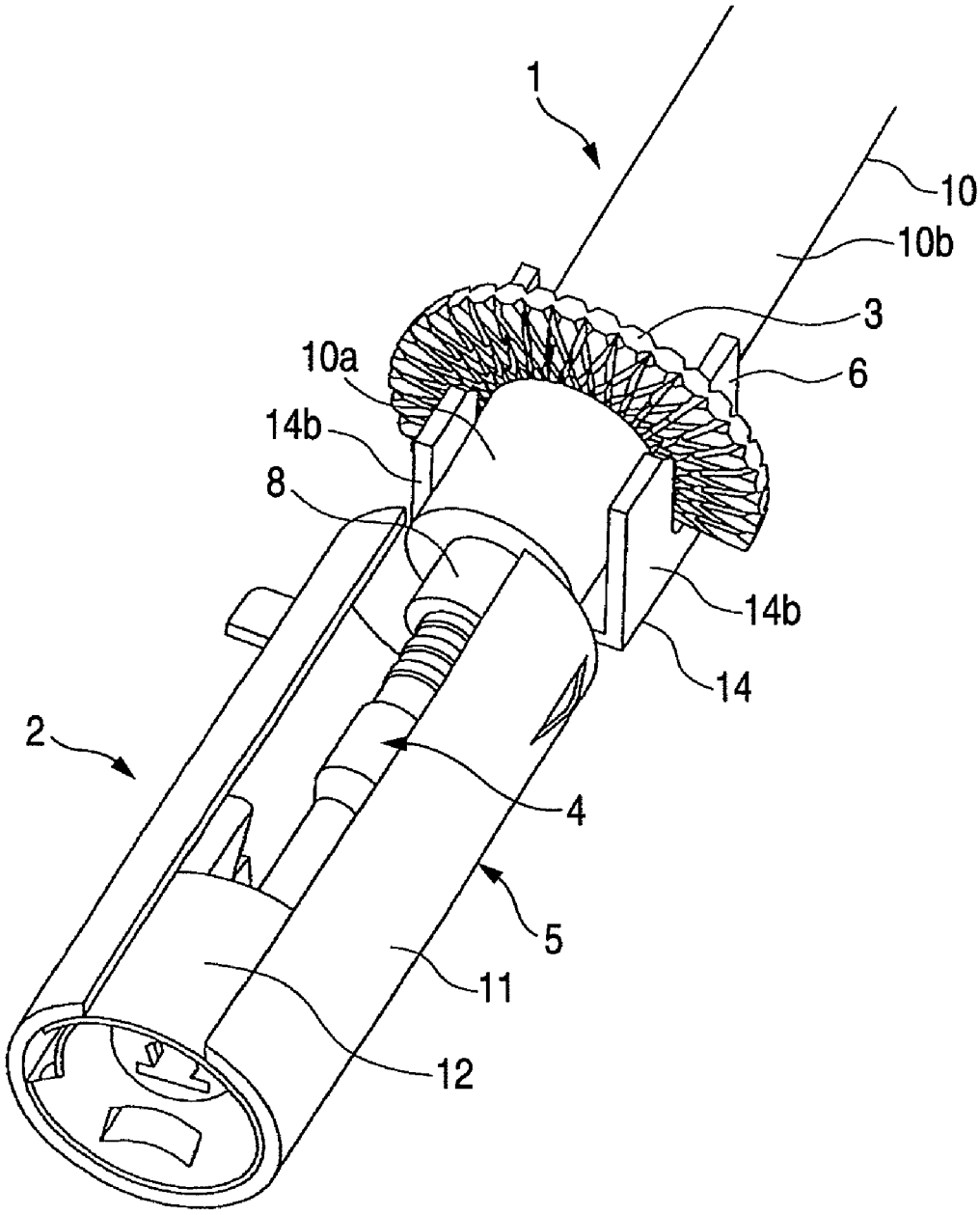
FIG. 8 is a perspective view showing a condition in which the annular projecting braid portion is connected by press-contacting to a braid fixing portion.
Figure 9:
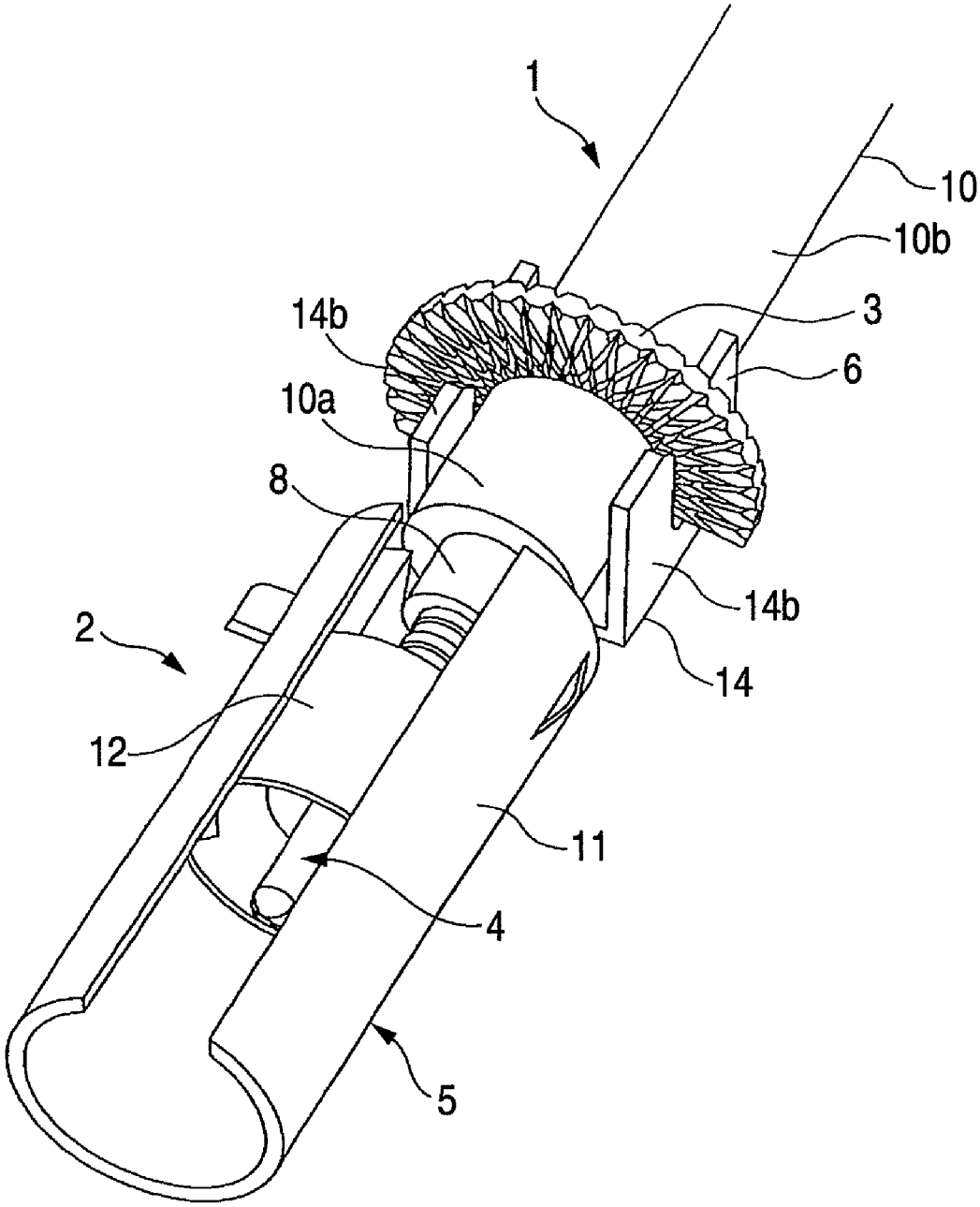
FIG. 9 is a perspective view showing a condition in which the connection between the coaxial cable and the coaxial cable shielding terminal is completed.

FIGS. 1A and 1B show a coaxial cable end-processing structure and a coaxial cable shielding terminal which are provided in accordance with the first embodiment of the invention, and FIG. 1A is a perspective view showing a condition before a connecting operation is effected, and FIG. 1B is a cross-sectional view showing a condition after the connecting operation is effected. FIG. 2 is a perspective view of a coaxial cable which is not yet processed, FIG. 3 is a perspective view of the coaxial cable, showing a condition in which an intermediate portion of an insulating sheath of the coaxial cable is removed, FIG. 4 is a perspective view of the coaxial cable, showing a condition in which an annular projecting braid portion is formed on the coaxial cable, FIG. 5 is a perspective view showing a condition in which a core conductor is exposed, FIG. 6 is a perspective view showing a condition in which an inner terminal is mounted on the core conductor, FIG. 7 is a perspective view showing a condition before the coaxial cable is connected to the coaxial cable shielding terminal, FIG. 8 is a perspective view showing a condition in which the annular projecting braid portion is connected by press-contacting to a braid fixing portion, and FIG. 9 is a perspective view showing a condition in which the connection between the coaxial cable and the coaxial cable shielding terminal is completed.

In the present specification, a structure of electrically and mechanically connecting a coaxial connector or a grounding-purpose metal terminal to an end portion of a coaxial cable will be defined as "coaxial cable end-processing structure". In the present specification, description will be made of the case where the coaxial connector is connected to the end portion of the coaxial cable, although the invention is not particularly limited to such a case.

In FIG. 1, reference numeral 1 denotes the coaxial cable, and reference numeral 2 denotes the coaxial connector. The coaxial cable 1 has the annular projecting braid portion 3 forming an important feature of the invention. The coaxial connector 2 comprises the inner terminal 4, and the shielding terminal (coaxial cable shielding terminal) 5. The shielding terminal 5 includes the braid fixing portion 6 forming an important feature of the invention. The constructions of these portions will be described below with reference to FIGS. 1 to 9.

The coaxial cable 1 comprises the core conductor 7 serving as a center conductor, an insulator 8 serving as a dielectric, a metallic tape conductor (not shown) and a braid 9 (which serve as an outer conductor), and the insulating sheath 10 serving as an outer covering. The core conductor 7 is disposed at the center of the coaxial cable 1, and the insulator 8, the metallic tape conductor, the braid 9 and the insulating sheath 10 are sequentially provided around the core conductor 7. The core conductor 7, the insulator 8, the metallic tape conductor, the braid 9 and the insulating sheath 10 are well known, and therefore detailed description thereof will be omitted here.

The annular projecting braid portion 3 is formed at the end portion of the coaxial cable 1. More specifically, this annular projecting braid portion 3 is formed at a portion of the coaxial cable 1 spaced a predetermined distance from the distal end of the coaxial cable 1. The annular projecting braid portion 3 is formed by processing a relevant portion of the braid 9, and is formed into an annular shape projecting radially outwardly from the insulating sheath 10 as shown in the drawings. "a braid exposed to the exterior of the insulating sheath" recited in the appended claims is not limited to the annular projecting braid portion 3. Namely, the braid can be exposed by a conventional method.

Here, the formation of the annular projecting braid portion 3 will be described. Initially, the end portion of the coaxial cable 1 is, for example, in a condition shown in FIG. 2. First, an intermediate portion of the insulating sheath 10 is removed, so that a first insulating sheath portion 10*a* and a second insulating sheath portion 10*b* are formed respectively at opposite sides of this sheath-removed portion as shown in FIG. 3. The first insulating sheath portion 10*a* is disposed at the distal end portion of the coaxial cable 1. The braid 9 is exposed through the sheath-removed portion. Then, the first insulating sheath portion 10*a* is drawn toward the second insulating sheath portion 10*b* as shown in FIG. 4. As a result of this drawing operation, the exposed braid 9 is projected into an annular shape radially outwardly from an interval between opposed ends of the first and second insulating sheath portions 10*a* and 10*b*. The annular projecting braid portion 3 is formed according to this procedure.

The braid 9 is particularly covered with the second insulating sheath portion 10*b*, and with this construction the annular projecting braid portion 3 itself will not move. The shielding terminal 5 is electrically and mechanically connected to the annular projecting braid portion 3 via the braid fixing portion 6 as will hereafter more fully be described.

The inner terminal 4 of the coaxial connector 2 is electrically and mechanically connected to the core conductor 7 of the coaxial cable 1 (see FIGS. 1 and 6) (When the first insulating sheath portion 10*a* is drawn toward the second insulating sheath portion 10*b* at the time of forming the annular projecting braid portion 3, the insulator 8 is exposed, and when part of this insulator 8 is removed as shown in FIG. 5, the core conductor 7 is exposed.) The inner terminal 4 has electrical conductivity, and is formed into a pin-like shape as shown in the drawings.

The shielding terminal 5, forming the coaxial connector 2, includes a shielding terminal body 11 of a generally tubular shape, a dielectric member 12 received within the shielding terminal body 11 so as to move forward and rearward, and the braid fixing portion 6 extending from a rear end of the shielding terminal body 11. The shielding terminal body 11 and the braid fixing portion 6 are formed by processing a thin metal sheet having electrical conductivity. The dielectric member 12 has a generally round cross-section, and a distal end portion of the inner terminal 4 can be inserted into the dielectric member 12 at the center thereof.

The braid fixing portion 6 includes an interconnecting portion 13 integrally connected to the shielding terminal body 11, and a fixing portion 14 for the annular projecting braid portion 3. The fixing portion 14 includes a base plate 14*a* extending from the interconnecting portion 13, and side plates 14*b* projecting upwardly respectively from opposite (right and left) side edges of the base plate 14*a*. The fixing portion 14 is formed into a generally U-shape. A press-contacting blade 14*c* is formed at each of the two side plates 14*b*. The press-contacting blade 14*c* is so formed as to be press-contacted with the annular projecting braid portion 3. The press-contacting blade 14*c* has an ordinary shape, that is, a slit-like shape as shown in the drawings.

Next, the procedure of processing the end portion of the coaxial cable 1 of the above construction will be described with reference to FIGS. 7 to 9.

The annular projecting braid portion 3 is formed at the coaxial cable 1, and thereafter the inner terminal 4 is fixed so as to be connected to the core conductor, thereby preparing the coaxial cable 1 shown in FIG. 7. Also, the shielding terminal 5 is prepared. The annular projecting braid portion 3 is formed according to the procedure described above. In the condition of FIG. 7, the inner terminal 4 is inserted into the shielding terminal body 11 of the shielding terminal 5 to be received therein as shown in FIG. 8. Also, the annular projecting braid portion 3 of the coaxial cable 1 is press-contacted with the press-contacting blades 14*c* of the braid fixing portion 6 of the shielding terminal 5. When the annular projecting braid portion 3 is thus press-contacted with the press-contacting blades 14*c*, the electrical and mechanical connection is completed. Finally, when the dielectric member 12 is slid rearward to hold the distal end portion of the inner terminal 4, the coaxial connector 2 is completely mounted on the end portion of the coaxial cable 1, thus completing the series of steps of the end processing operation.

As described above with reference to FIGS. 1 to 9, in the end processing structure of the invention, the annular projecting braid portion 3, formed at the coaxial cable 1, is fixed so as to be connected to the braid fixing portion 6 of the shielding terminal 5 of the coaxial connector 2. Therefore, as will be appreciated from the foregoing description, in the invention, the end processing operation can be more easily carried out as compared with the conventional structure. Namely, in the invention, the annular projecting braid portion 3 is formed, and this obviates the need for a braid-undoing operation as required in the conventional structure. And besides, the invention obviates the need for an operation for inserting part of the shielding terminal into the inside of the shielding terminal as in the conventional structure. Therefore, in the invention, the end processing operation can be easily carried out (The shielding terminal 5 of the invention also achieve similar advantages.).

Furthermore, the invention obviates the need for using a metallic sleeve as required in the conventional structure. Therefore, the end processing of the coaxial cable 1 can be effected with a smaller number of the component parts as compared with the conventional structure. Furthermore, in the structure of the invention, the contours of the transverse cross-sections of the insulator 8 and the outer conductor of the coaxial cable 1 are not deformed. Therefore, the high-frequency characteristics can be maintained more satisfactorily as compared with the conventional structure. Furthermore, in the invention, the braid 9, covered with the second insulating sheath portion 10*b*, is not moved because of the structural nature, and therefore the shielding terminal 5, fixed so as to be connected to the annular projecting braid portion 3, can be stably held in position. Therefore, the tensile strength can be maintained more satisfactorily as compared with the conventional structure.

Second Embodiment

Next, a coaxial cable end-processing structure and a coaxial cable shielding terminal, provided in accordance with the second embodiment of the invention, will be described with reference to FIGS. 10 to 12.

Figure 10:
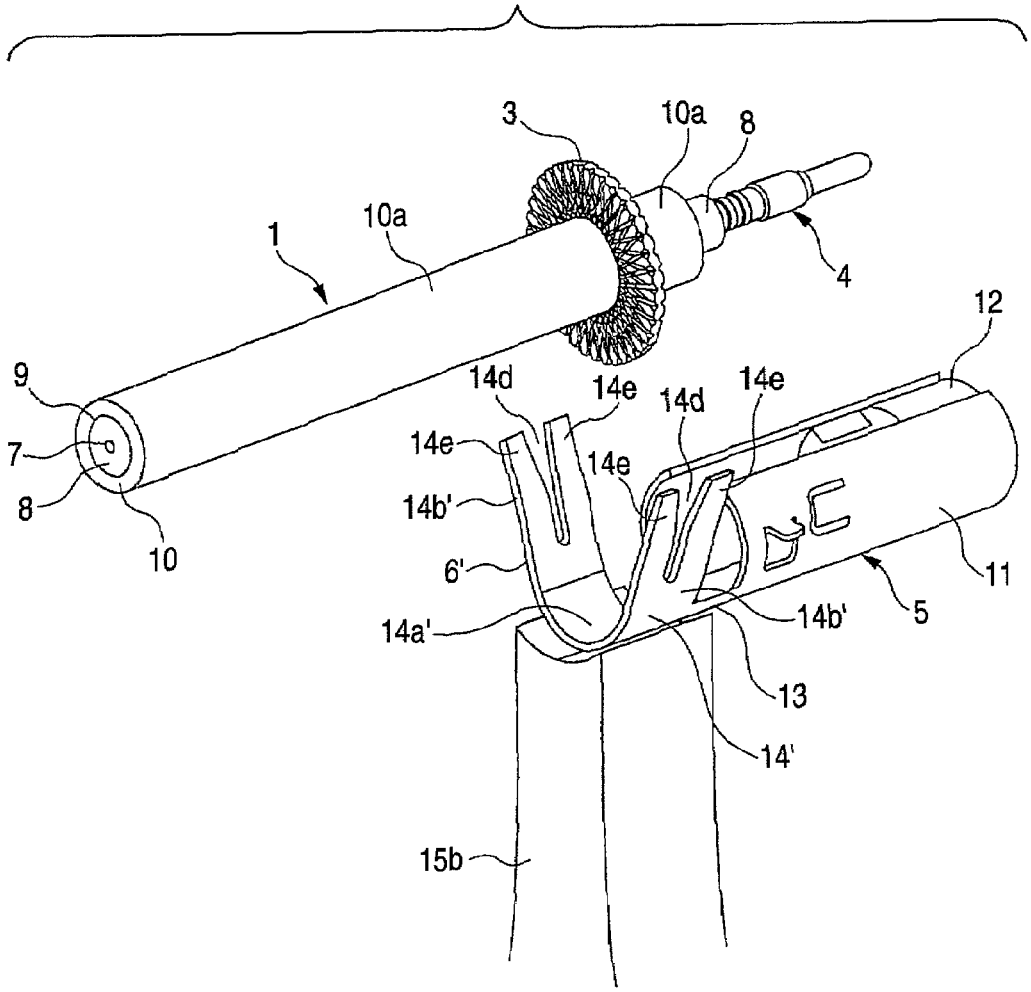
FIG. 10 shows a coaxial cable end-processing structure and a coaxial cable shielding terminal provided in accordance with a second embodiment of the invention, and is a perspective view showing a condition before a coaxial cable is connected to the coaxial cable shielding terminal.
Figure 11:
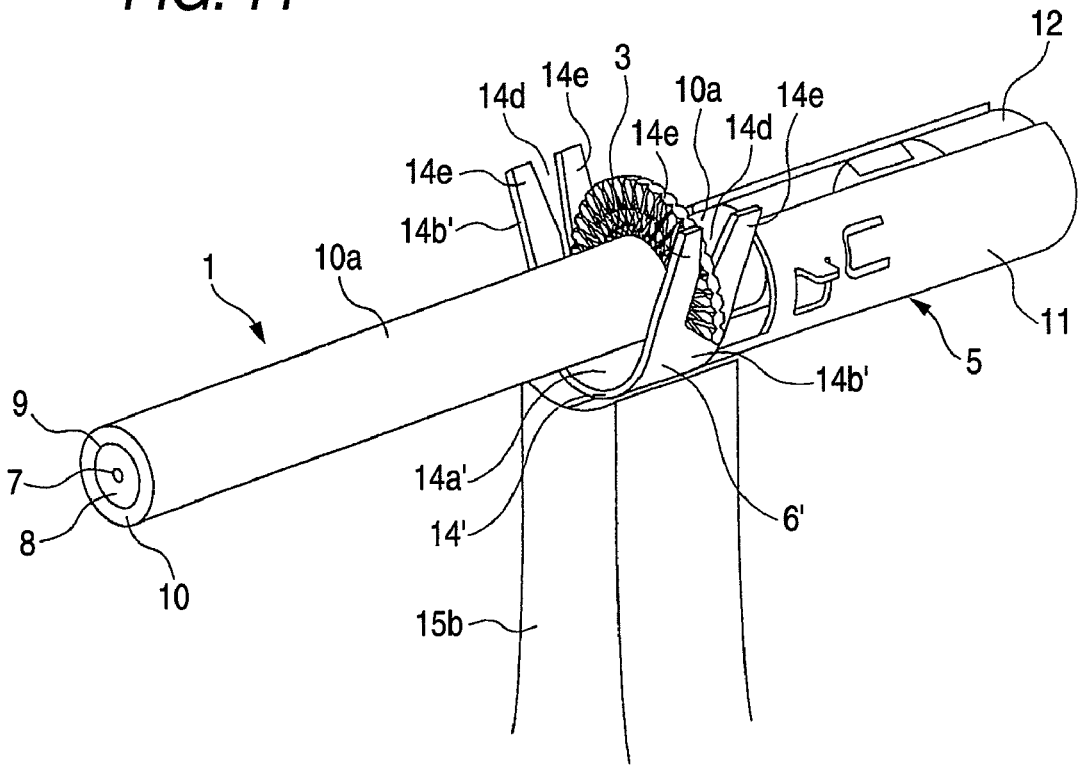
FIG. 11 is a perspective view showing a condition in which an annular projecting braid portion is set on a braid fixing portion.
Figure 12:
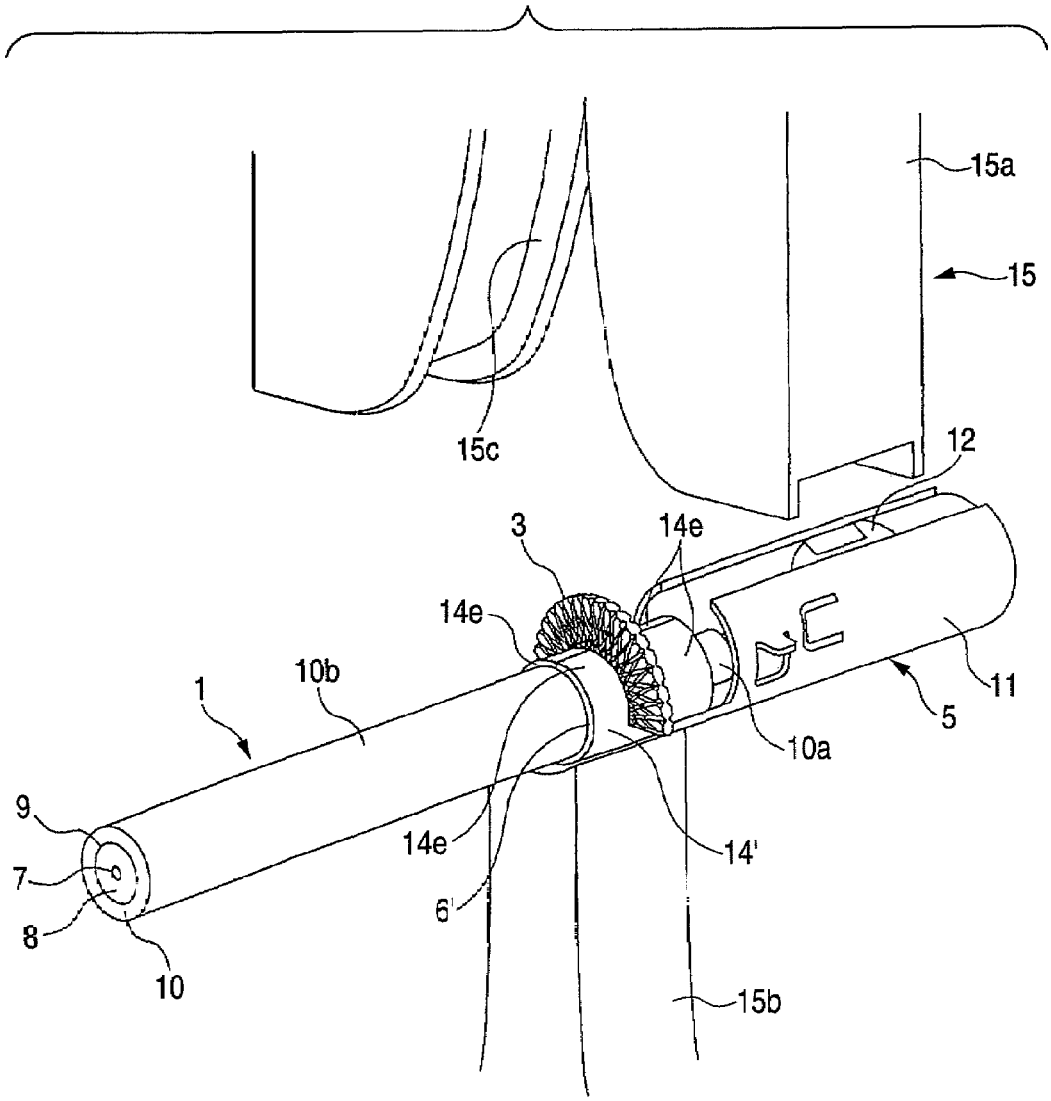
FIG. 12 is a perspective view showing a condition in which the braid fixing portion is pressed to be connected by press-clamping to the annular projecting braid portion.

FIG. 10 is a perspective view of this embodiment, showing a condition before a coaxial cable is connected to the coaxial cable shielding terminal, FIG. 11 is a perspective view showing a condition in which an annular projecting braid portion is set on a braid fixing portion, and FIG. 12 is a perspective view showing a condition in which the braid fixing portion is pressed to be connected by press-clamping to the annular projecting braid portion.

In the end processing structure of this embodiment, the annular projecting braid portion 3, formed at the coaxial cable 1, is fixed so as to be connected to the braid fixing portion 6' of the shielding terminal 5 of a coaxial connector 2 as in the above embodiment (Those portions, basically identical to the corresponding portions of the above embodiment, will be designated by identical reference numerals, respectively, and explanation thereof will be omitted. Slightly-different portions will be designated respectively by identical reference numerals each with a dash (').). The braid fixing portion 6' of the shielding terminal 5 is so formed as to be connected by press-clamping to the annular projecting braid portion 3.

The braid fixing portion 6' will be described more specifically. The braid fixing portion 6' includes an interconnecting portion 13 integrally connected to a shielding terminal body 11, and a fixing portion 14' for the annular projecting braid portion 3. The fixing portion 14' includes a base plate 14*a*' extending from the interconnecting portion 13, and side plates 14*b*' projecting upwardly respectively from opposite (right and left) side edges of the base plate 14*a*'. The base plate 14*a*' is formed into an arcuate shape. Each of the side plates 14*b*' has a slit 14*d* and insulating sheath-holding portions 14*e*.

Each slit portion 14*d* serves as a portion for gripping the annular projecting braid portion 3 in a press-clamping manner. When each side plate 14*b*' is press-deformed, the width of the slit 14*d* is decreased, so that the annular projecting braid portion 3 is gripped by the slit portion 14*d* as more fully described later. Each side plate 14*b*' has the two insulating sheath-holding portions 14*e* formed respectively on the opposite sides of the slit 14*d*, and the two insulating sheath-holding portions 14*e* of each side plate 14*b*', when press-deformed, supplementally hold a first insulating sheath portion 10*a* and a second insulating sheath portion 10*b*, respectively (to such a degree as not to deform the contours of transverse cross-sections of an insulator 8 and an outer conductor of the coaxial cable 1) (When the annular projecting braid portion 3 is thus gripped by the slit portions 14*d*, the electrical connection of the braid fixing portion 6' to the annular projecting braid portion 3 is completed. Also, the tensile strength is maintained.).

The annular projecting braid portion 3 is formed at the coaxial cable 1, and thereafter an inner terminal 4 is fixed so as to be connected to the coaxial cable, thereby preparing the coaxial cable 1 shown in FIG. 10. Also, the shielding terminal 5, having the braid fixing portion 6', is prepared. In the condition of FIG. 10, the inner terminal 4 is inserted into the shielding terminal body 11 of the shielding terminal 5 to be received therein as shown in FIG. 11. Also, the annular projecting braid portion 3 of the coaxial cable 1 is inserted into the slits 14*d* in the braid fixing portion 6' of the shielding terminal 5, and is set on the braid fixing portion 6'. Further, a dielectric member 12 is slid rearward to hold the distal end portion of the inner terminal 4 (This operation may be carried out at a final step of the end processing operation.).

Finally, the side plates 14*b*' of the braid fixing portion 6' are press-deformed by the use of a press-fastening apparatus 15 as shown in FIG. 12, and by doing so, the width of each of the slits 14*d* is decreased, and also the first insulating sheath portion 10*a* and the second insulating sheath portion 10*b* are supplementally held by the insulating sheath-holding portions 14*e*. As a result, the coaxial connector 2 is completely mounted on the end portion of the coaxial cable 1, thus completing the series of steps of the end processing operation.

In FIG. 12, the press-fastening apparatus 15 comprises a press-deforming blade 15*a* for press-clamping purposes, and a reception portion 15*b*. The press-deforming blade 15*a* has a tapering portion 15*c* (having a tapering shape) for press-deforming the corresponding side plate 14*b*' to decrease the width of the slit 14*d* while guiding the side plate 14*b*'. In this embodiment, the annular projecting braid portion 3 is squeezed in the direction of the thickness thereof.

As described above with reference to FIGS. 10 to 12, in this embodiment, there are provided the end processing structure and the shielding terminal 5 similar to those of the preceding embodiments, and therefore in the invention, the operation can be carried out more easily as compared with the conventional structure. And besides, in the invention, the number of the component parts can be reduced as compared with the conventional structure. Furthermore, in the invention, the high-frequency characteristics and the tensile strength can be satisfactorily maintained.

Third Embodiment

Next, a coaxial cable end-processing structure and a coaxial cable shielding terminal, provided in accordance with the third embodiment of the invention, will be described with reference to FIGS. 13 to 15.

Figure 13:
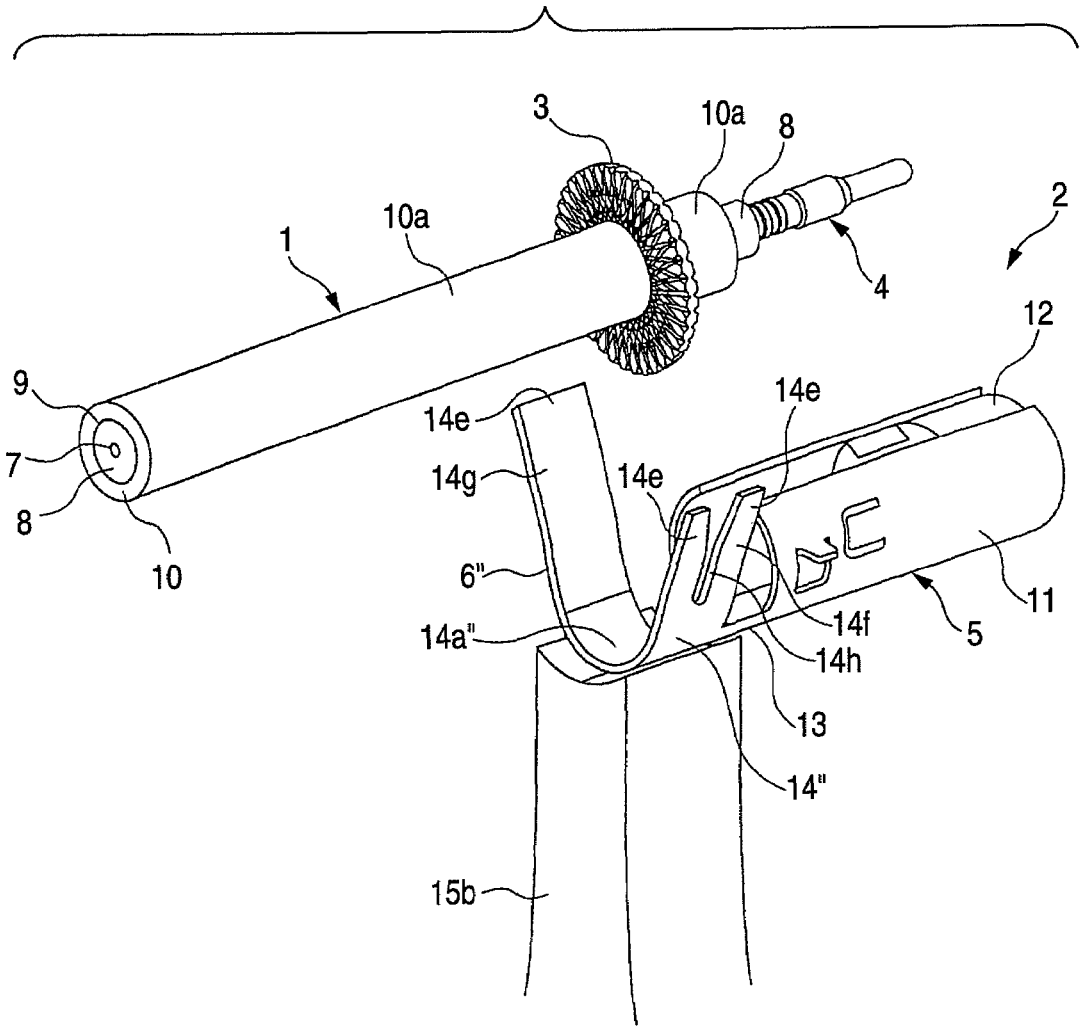
FIG. 13 is a schematic perspective view showing a coaxial cable end-processing structure and a coaxial cable shielding terminal provided in accordance with a third embodiment of the invention.
Figure 14:
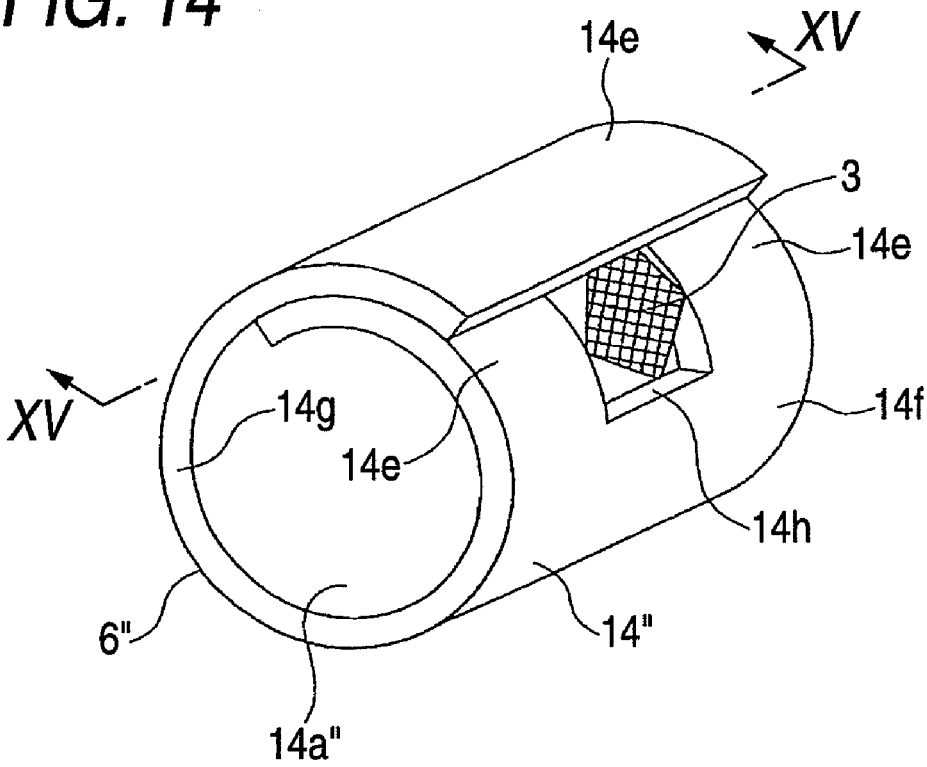
FIG. 14 is a schematic perspective view showing a condition in which a braid fixing portion is press-deformed to be connected by press-clamping to an annular projecting braid portion.
Figure 15:
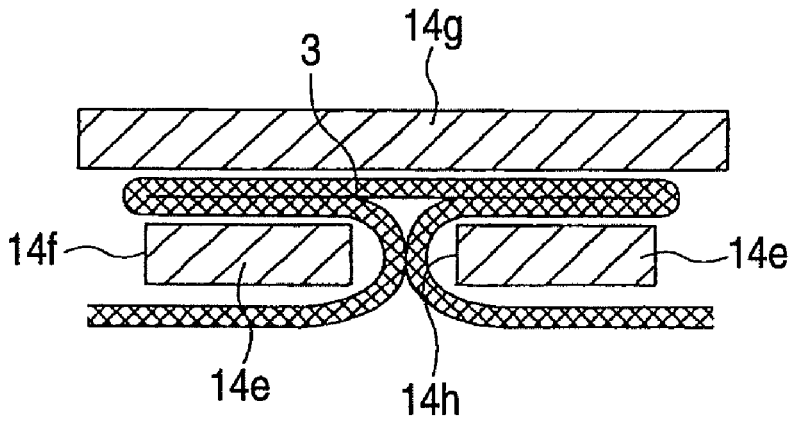
FIG. 15 is a cross-sectional view taken along the line XV-XV of FIG. 14.

FIG. 13 is a schematic perspective view showing the third embodiment of the invention, FIG. 14 is a schematic perspective view showing a condition in which a braid fixing portion is press-deformed to be connected by press-clamping to an annular projecting braid portion, and FIG. 15 is a cross-sectional view taken along the line XV-XV of FIG. 14.

In the end processing structure of this embodiment, the annular projecting braid portion 3, formed at a coaxial cable 1, is fixed so as to be connected to the braid fixing portion 6" of a shielding terminal 5 of a coaxial connector 2 as in the above two embodiments (Those portions, basically identical to the corresponding portions of the above embodiments, will be designated by identical reference numerals, respectively, and explanation thereof will be omitted. Slightly-different portions will be designated respectively by identical reference numerals each with a dash (").). The braid fixing portion 6" of the shielding terminal 5 is so formed as to be connected by press-clamping to the annular projecting braid portion 3.

The braid fixing portion 6" will be described more specifically. The braid fixing portion 6" includes an interconnecting portion 13 integrally connected to a shielding terminal body 11, and a fixing portion 14" for the annular projecting braid portion 3. The fixing portion 14" includes a base plate 14*a*" extending from the interconnecting portion 13, and side plates 14*f* and 14*g* projecting upwardly respectively from opposite (right and left) side edges of the base plate 14*a*". The base plate 14*a*" is formed into an arcuate shape. The side plate

14*f* has a slit 14*h* and insulating sheath-holding portions 14*e*. The side plate 14*g* has only an insulating sheath-holding portion 14*e*.

The slit 14*h* serves as a portion for allowing the annular projecting braid portion 3 to project outwardly therethrough. When the side plates 14*f* and 14*g* are press-deformed, their insulating sheath-holding portions 14*e* supplementally hold a first insulating sheath portion 10*a* and a second insulating sheath portion 10*b* (to such a degree as not to deform the contours of transverse cross-sections of an insulator 8 and an outer conductor of the coaxial cable 1).

The annular projecting braid portion 3 is formed at the coaxial cable 1, and thereafter an inner terminal 4 is fixed so as to be connected to the coaxial cable, thereby preparing the coaxial cable 1 shown in FIG. 13. Also, the shielding terminal 5, having the braid fixing portion 6", is prepared. In the condition of FIG. 13, the annular projecting braid portion 3 of the coaxial cable 1 is inserted into the slit 14*h* in the braid fixing portion 6" of the shielding terminal 5, and is set on this braid fixing portion 6" although this condition is not particularly shown in the drawings. Finally, the side plates 14*f* and 14*g* are press-deformed by the use of a press-fastening apparatus (not shown), so that the annular projecting braid portion 3 is held between distal end portions of the side plates 14*f* and 14*g* as shown in FIGS. 14 and 15, thereby electrically and mechanically connecting the braid fixing portion 6" to the annular projecting braid portion 3 (In this embodiment, the annular projecting braid portion 3 is squeezed radially.). As a result, the series of steps of the end processing operation are completed.

As described above with reference to FIGS. 13 to 15, in this embodiment, there are provided the end processing structure and the shielding terminal similar to those of the above embodiments, and therefore in the invention, the operation can be carried out more easily as compared with the conventional structure. And besides, in the invention, the number of the component parts can be reduced as compared with the conventional structure. Furthermore, in the invention, the high-frequency characteristics and the tensile strength can be satisfactorily maintained.

Fourth Embodiment

The fourth embodiment of the present invention will now be described with reference to the drawings.

Figure 16:
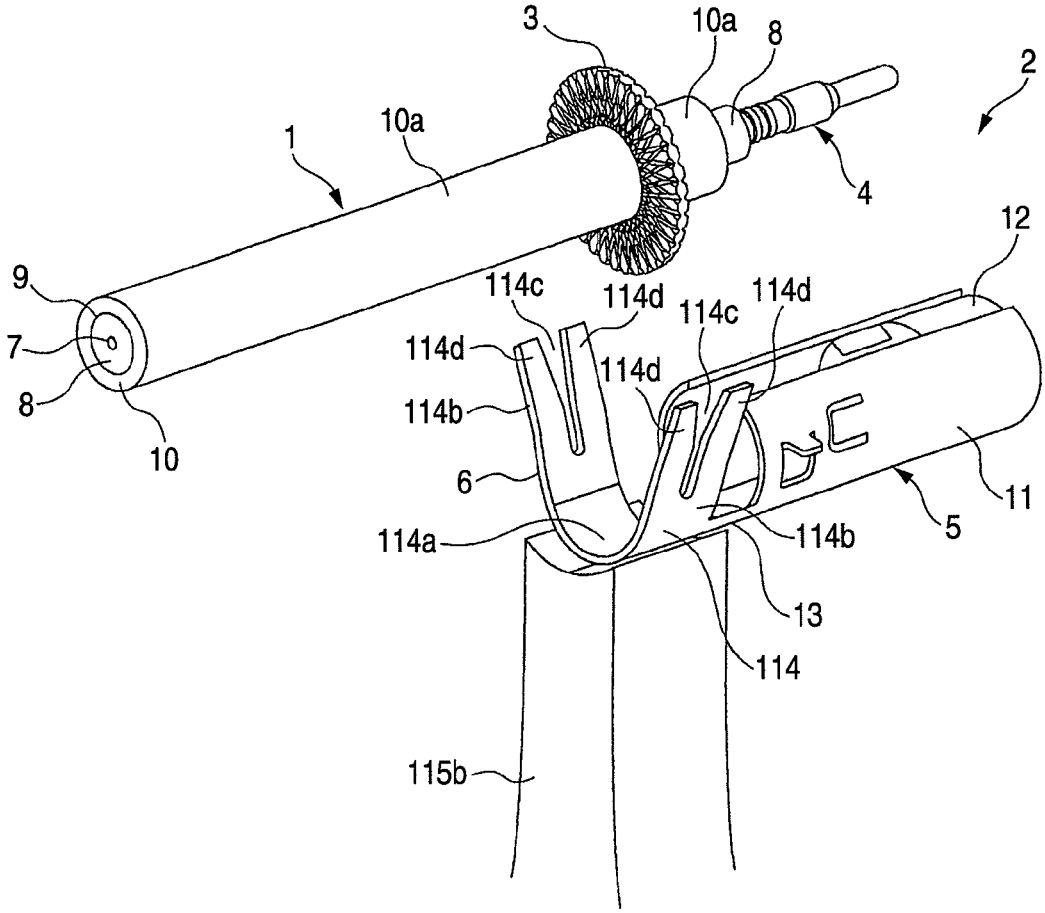
FIG. 16 shows a coaxial cable end-processing structure and a coaxial cable shielding terminal which are provided in accordance with a fourth embodiment of the present invention, and is a perspective view showing a condition before a coaxial cable is connected to the coaxial cable shielding terminal.
Figure 17:
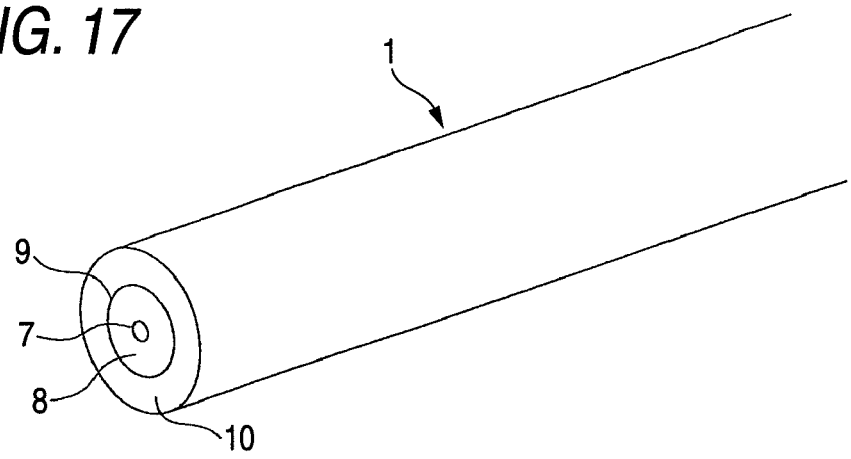
FIG. 17 is a perspective view of the coaxial cable which is not yet processed.
Figure 18:
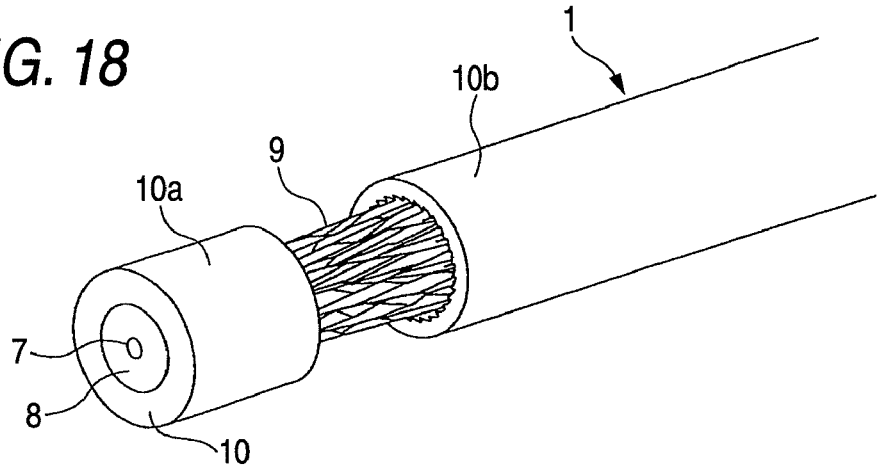
FIG. 18 is a perspective view of the coaxial cable, showing a condition in which an intermediate portion of an insulating sheath of the coaxial cable is removed.
Figure 19:
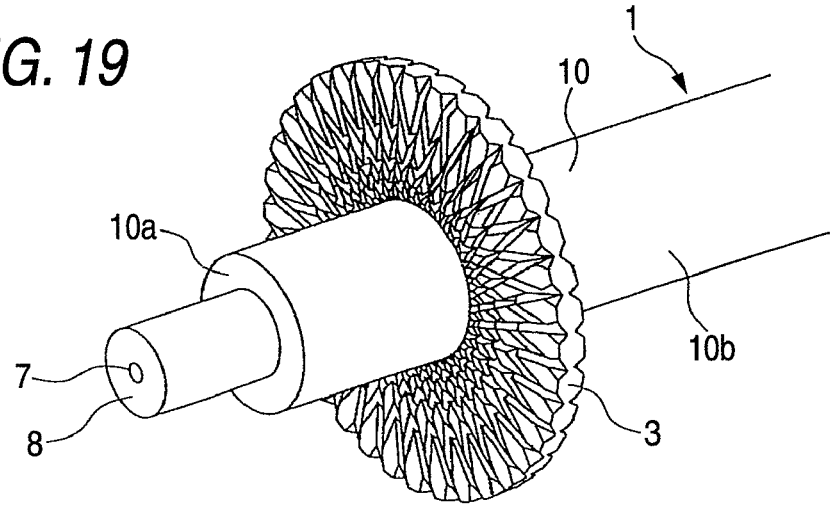
FIG. 19 is a perspective view of the coaxial cable, showing a condition in which an annular projecting braid portion is formed on the coaxial cable.
Figure 20:
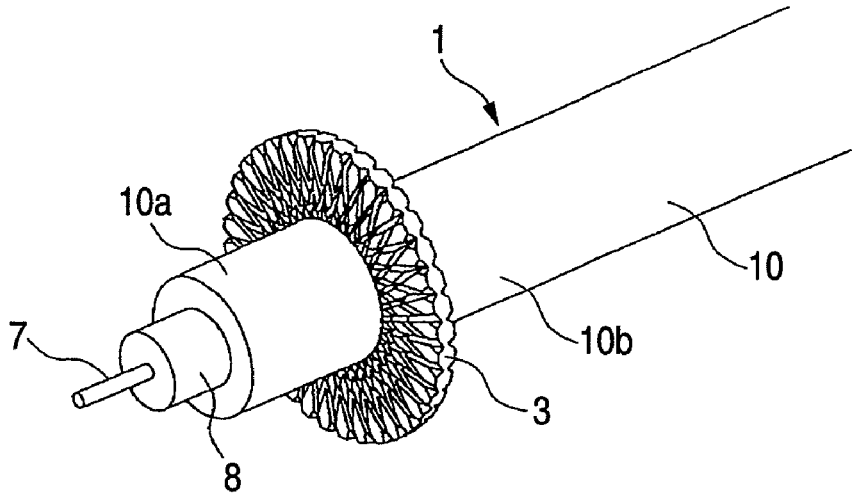
FIG. 20 is a perspective view showing a condition in which a core conductor is exposed.
Figure 21:
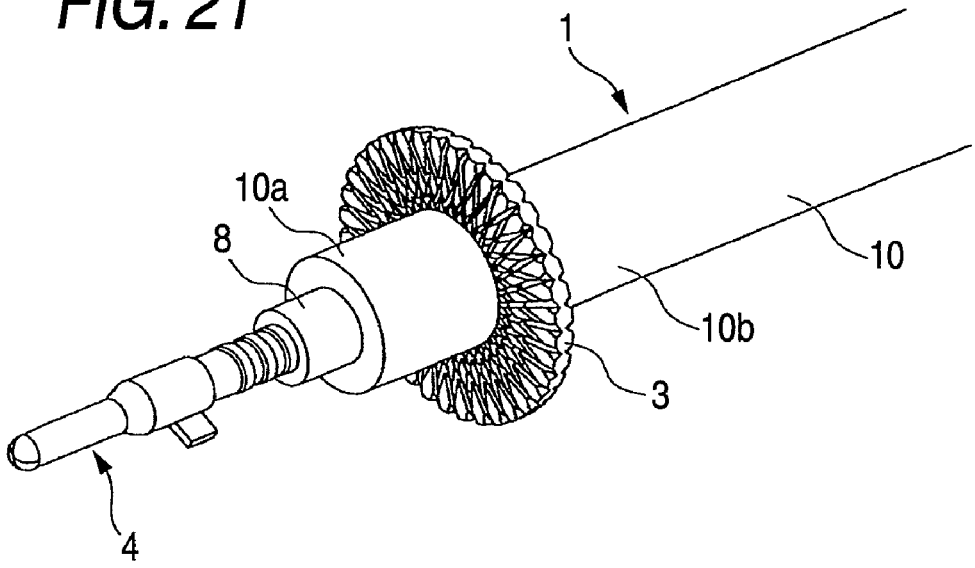
FIG. 21 is a perspective view showing a condition in which an inner terminal is mounted on the core conductor.

FIG. 16 shows a coaxial cable end-processing structure and a coaxial cable shielding terminal which are provided in accordance with the fourth embodiment of the invention, and is a perspective view showing a condition before a coaxial cable is connected to the coaxial cable shielding terminal. FIG. 17 is a perspective view of the coaxial cable which is not yet processed, FIG. 18 is a perspective view of the coaxial cable, showing a condition in which an intermediate portion of an insulating sheath of the coaxial cable is removed, FIG. 19 is a perspective view of the coaxial cable, showing a condition in which an annular projecting braid portion is formed on the coaxial cable, FIG. 20 is a perspective view showing a condition in which a core conductor is exposed, and FIG. 21 is a perspective view showing a condition in which an inner terminal is mounted on the core conductor.

As shown in FIG. 16, the shielding terminal 5 of this embodiment includes the braid fixing portion 6 (including a press-clamping portion 114 recited in the appended claims). The constructions of these portions will be described below with reference to FIGS. 16 to 21.

The braid fixing portion 6 according to the fourth embodiment includes an interconnecting portion 13 integrally connected to the shielding terminal body 11, and the press-clamping portion 114 for the annular projecting braid portion 3. The press-clamping portion 114 includes a base plate 114*a* extending from the interconnecting portion 13, and press-fastening piece portions 114*b* projecting upwardly respectively from opposite (right and left) side edges of the base plate 114*a*. The base plate 114*a'* is formed into an arcuate shape. Each of the press-fastening piece portions 114*b* has a slit 114*c* and insulating sheath-holding portions 114*d*.

Each slit 114*c* extends in a direction perpendicular to a direction of extending of the coaxial cable 1. Each slit portion 114*c* serves as a portion for gripping the annular projecting braid portion 3 in a press-clamping manner. When each press-fastening piece portion 114*b* is press-deformed, the width of the slit 114*c* is decreased, so that the annular projecting braid portion 3 is gripped by the slit portion 114*c* as more fully described later (The slit portion can grip the annular projecting braid portion 3 and the end portions of the first and second insulating sheath portions 10*a* and 10*b* together. When the annular projecting braid portion 3 is thus gripped by the slit portions 114*c*, the electrical connection of the braid fixing portion 6 to the annular projecting braid portion 3 is completed. Also, the tensile strength is maintained.).

Each press-fastening piece portion 114*b* has the two insulating sheath-holding portions 114*d* formed respectively on the opposite sides of the slit 114*c*. The two insulating sheath-holding portions 114*d* of each press-fastening piece portion 114*b*, when press-deformed, supplementally hold the first insulating sheath portion 10*a* and the second insulating sheath portion 10*b*, respectively (to such a degree as not to deform the contours of transverse cross-sections of the insulator 8 and the outer conductor of the coaxial cable 1).

Next, the procedure of processing the end portion of the coaxial cable 1 of the above construction will be described with reference to FIGS. 16 and 22 to 28. Also, the press-fastening apparatus of the invention will be described.

Figure 22:
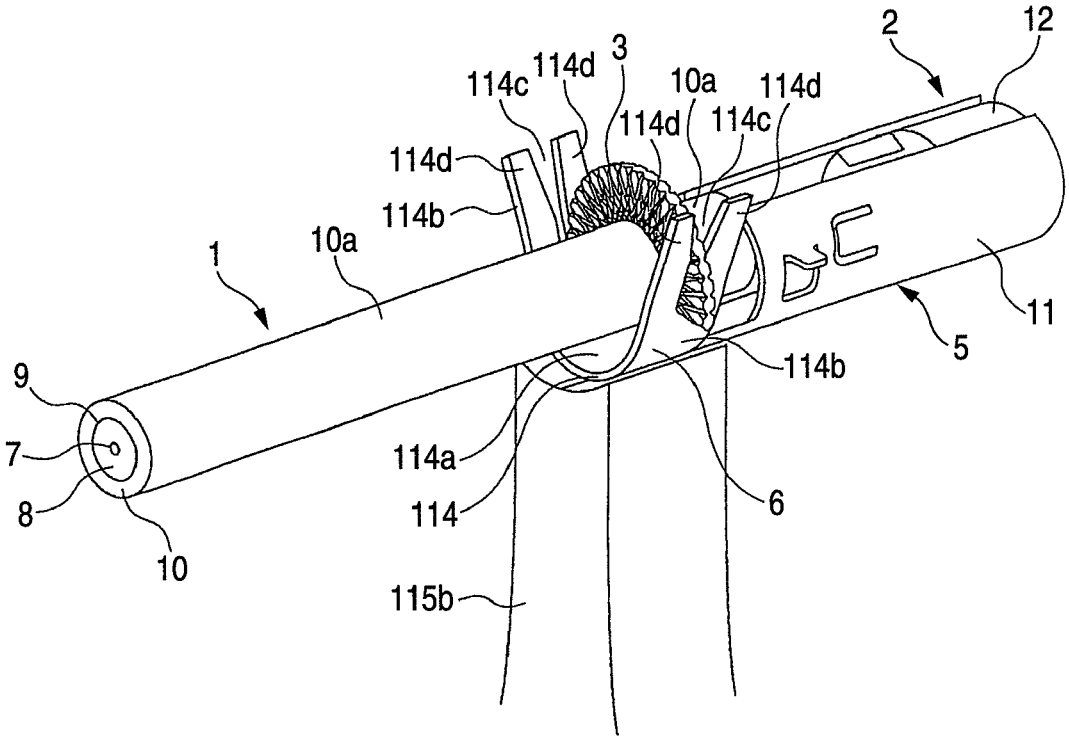
FIG. 22 is a perspective view showing a condition in which the coaxial cable is set on the coaxial cable shielding terminal.
Figure 23:
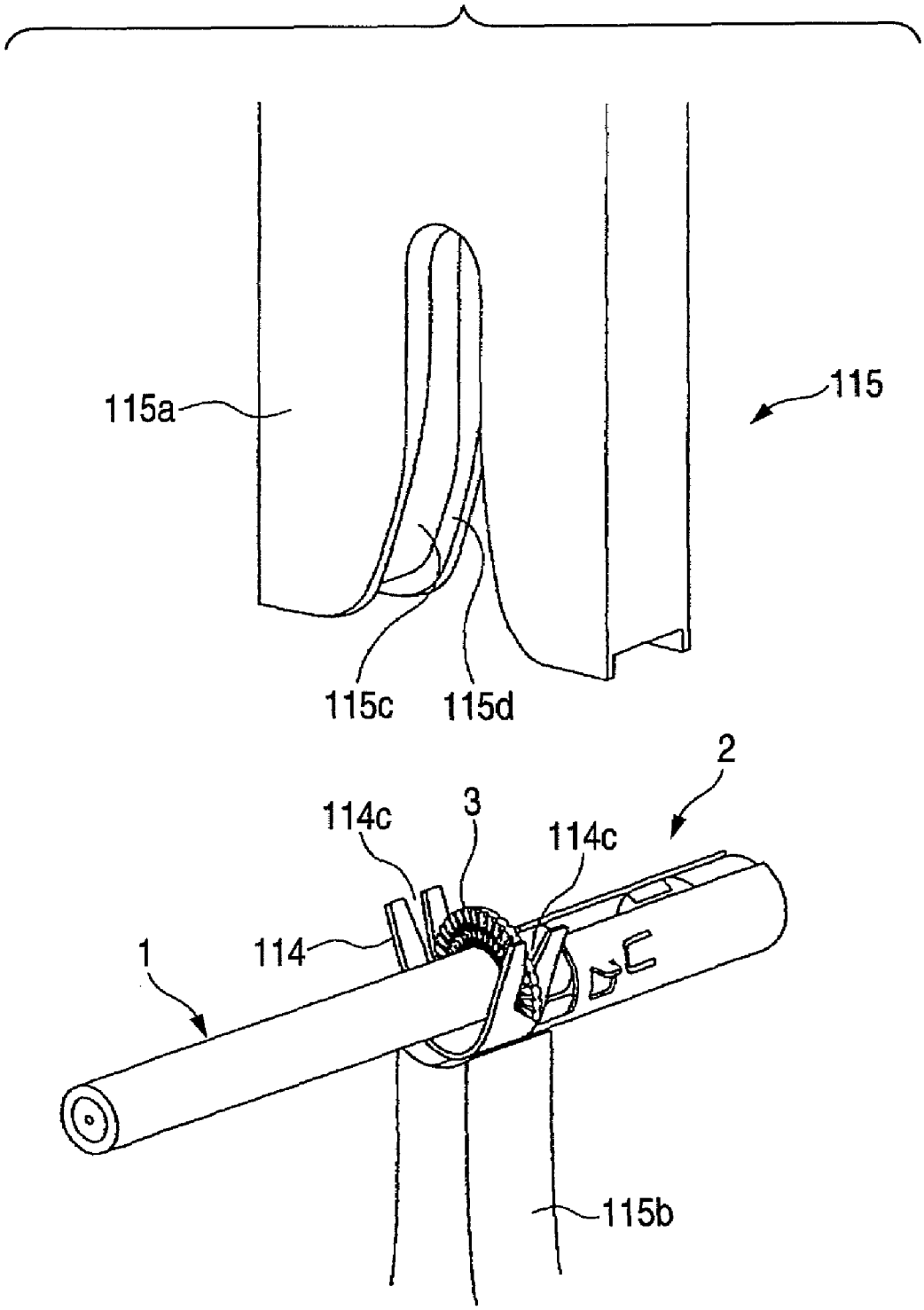
FIG. 23 is a perspective view showing a condition immediately before a press-fastening process is started.
Figure 24:
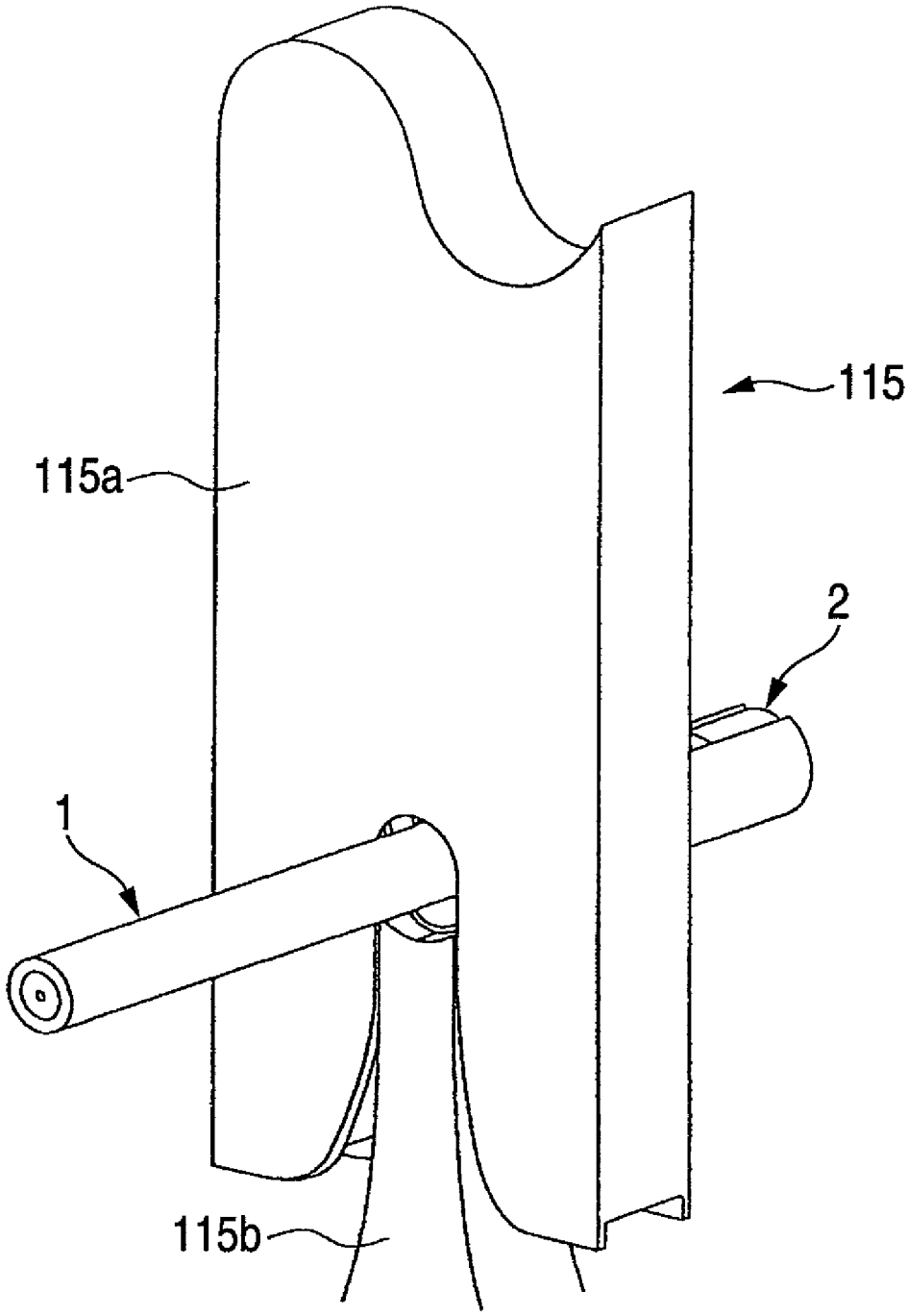
FIG. 24 is a perspective view showing the press-fastening process.
Figure 25:
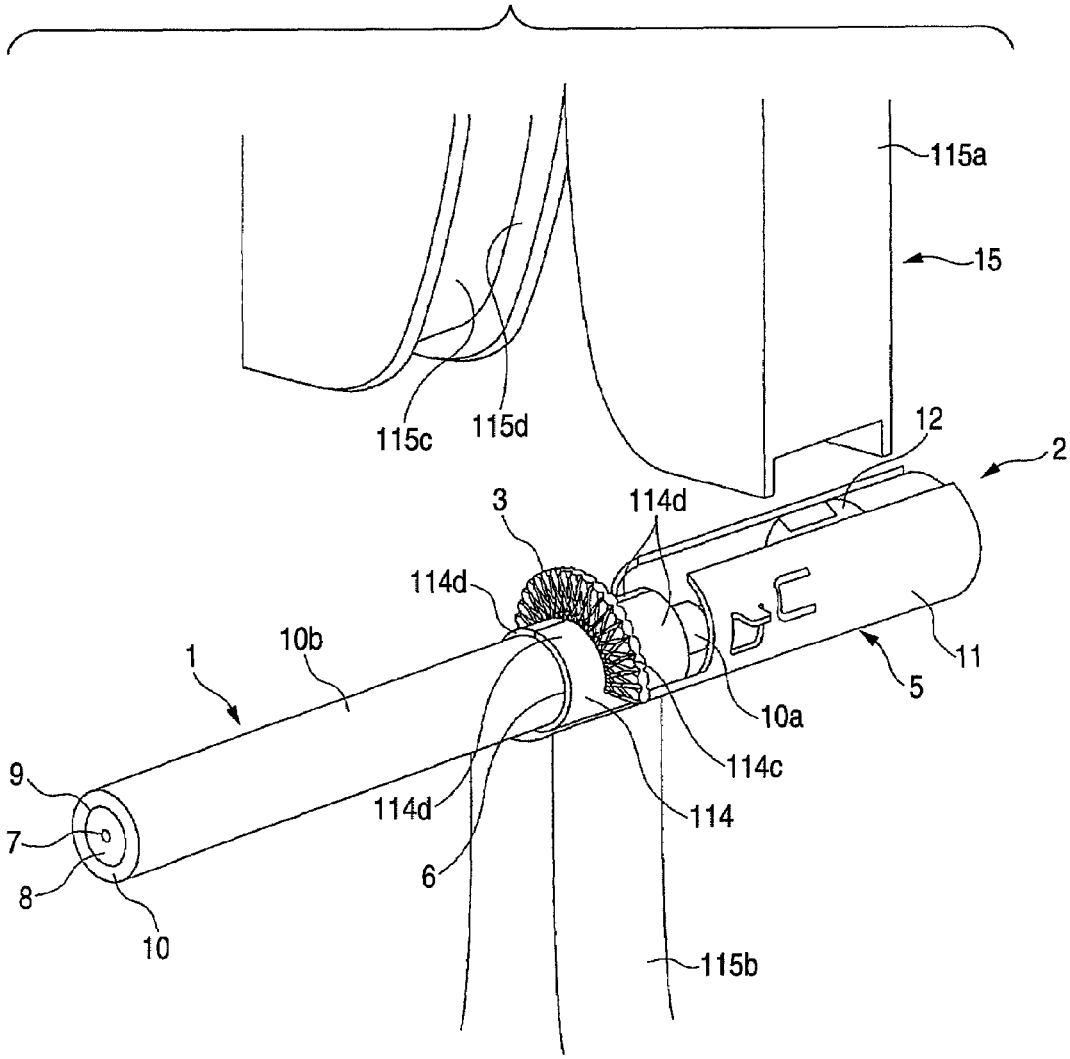
FIG. 25 is a perspective view showing a condition in which the connection between the coaxial cable and the coaxial cable shielding terminal is completed.
Figure 26:
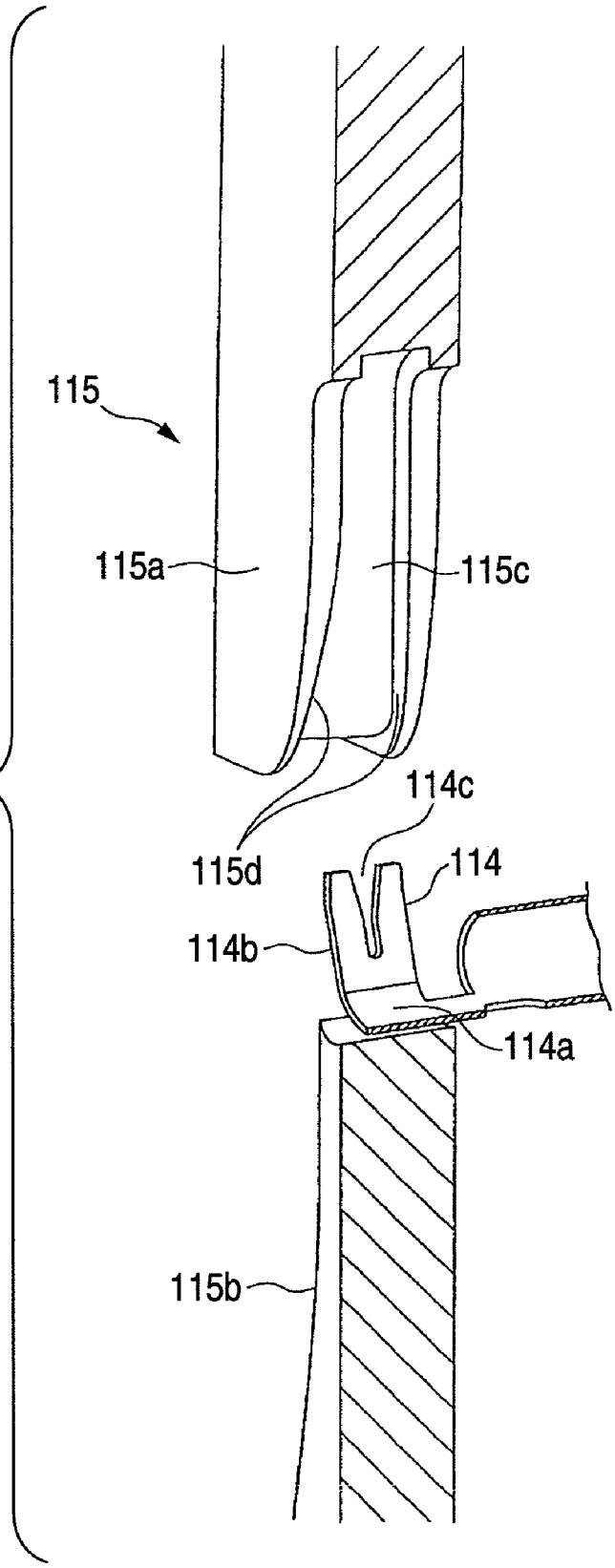
FIG. 26 is a perspective view showing the press-clamping portion and a press-clamping portion guide groove in a condition immediately before the press-fastening process is started.
Figure 27:
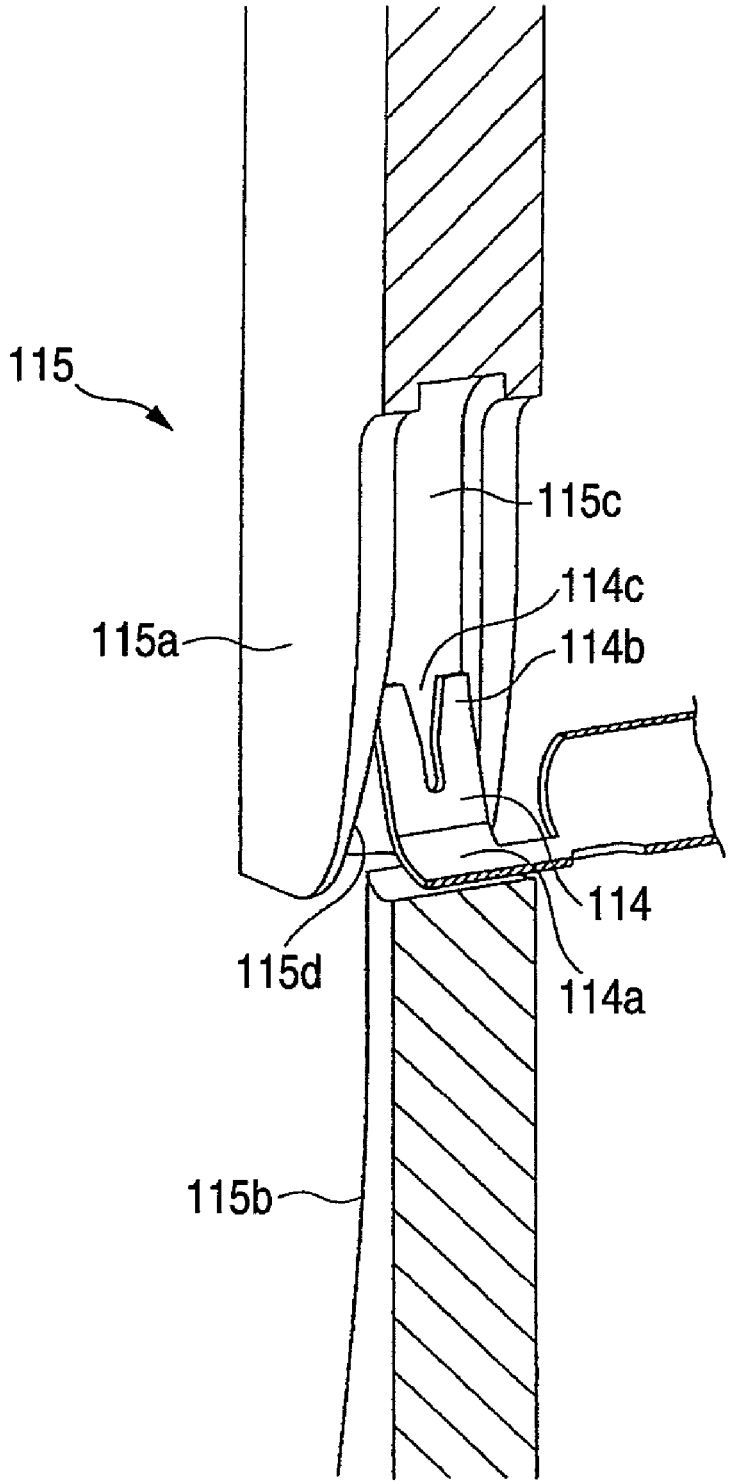
FIG. 27 is a perspective view showing a condition in which the press-clamping portion is guided into the press-clamping portion guide groove (that is, showing a condition before the width of the slit is decreased).
Figure 28:
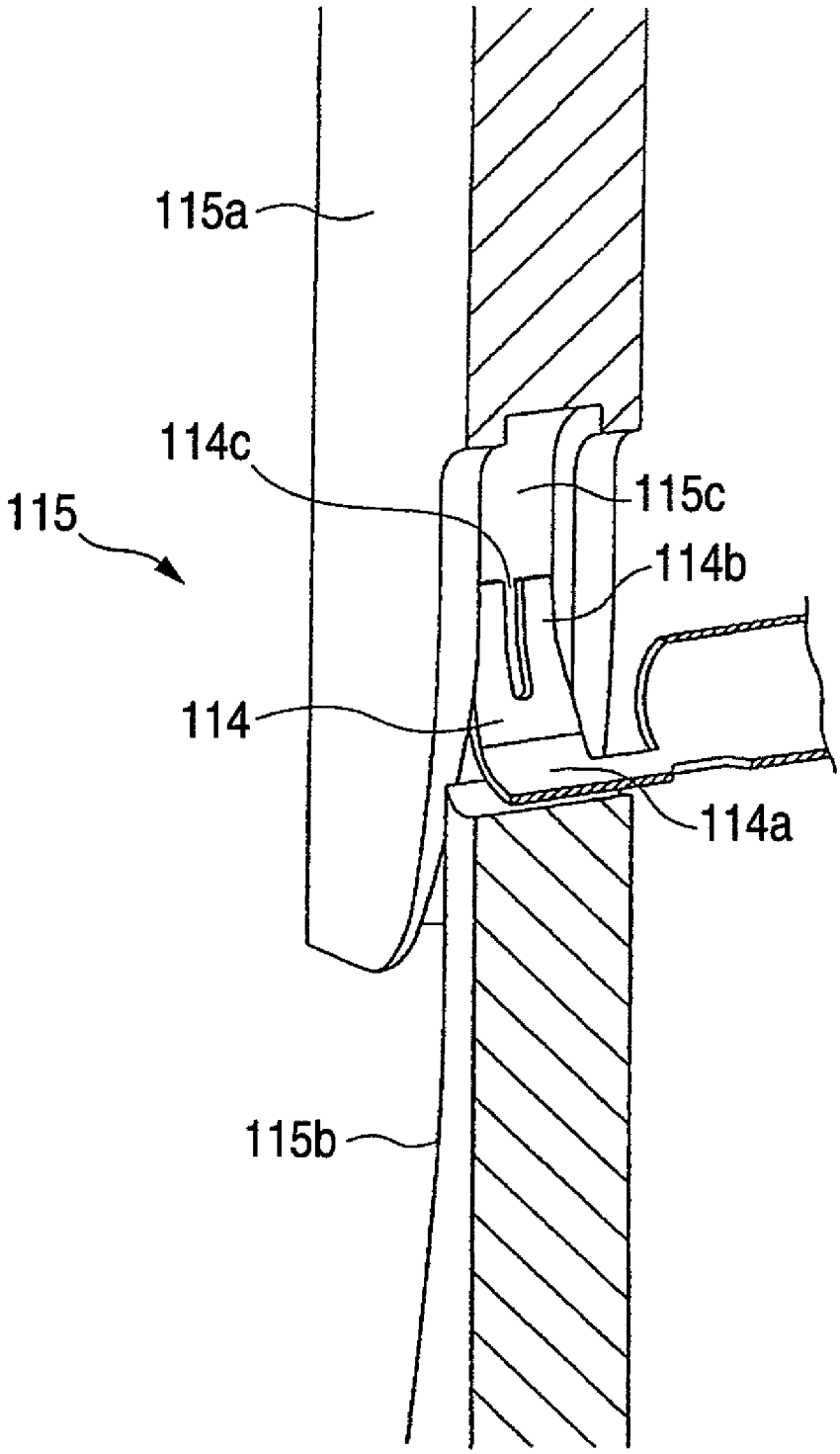
FIG. 28 is a perspective view showing a condition in which the press-clamping portion is completely guided into the press-clamping portion guide groove (that is, showing a condition after the width of the slit is decreased).

FIG. 22 is a perspective view showing a condition in which the coaxial cable is set on the coaxial cable shielding terminal, FIG. 23 is a perspective view showing a condition immediately before the press-fastening process is started, FIG. 24 is a perspective view showing the press-fastening process, FIG. 25 is a perspective view showing a condition in which the connection between the coaxial cable and the coaxial cable shielding terminal is completed, FIG. 26 is a perspective view showing the press-clamping portion and a press-clamping portion guide groove in a condition immediately before the press-fastening process is started, FIG. 27 is a perspective view showing a condition in which the press-clamping portion is guided into the press-clamping portion guide groove (that is, showing a condition before the width of the slit is decreased), and FIG. 28 is a perspective view showing a condition in which the press-clamping portion is completely guided into the press-clamping portion guide groove (that is, showing a condition after the width of the slit is decreased).

The annular projecting braid portion 3 is formed at the coaxial cable 1, and thereafter the inner terminal 4 is fixed so as to be connected to the core conductor, thereby preparing the coaxial cable 1 shown in FIG. 16. Also, the shielding terminal 5, including the braid fixing portion 6 having the press-clamping portion 114, is prepared. The annular projecting braid portion 3 is formed according to the procedure described above. In the condition of FIG. 16, the inner terminal 4 is inserted into the shielding terminal body 11 of the shielding terminal 5 to be received therein as shown in FIG. 22. Also, the annular projecting braid portion 3 of the coaxial cable 1 is inserted into the slits 114*c* in the braid fixing portion 6 of the shielding terminal 5, and is set on the braid fixing portion 6. Further, the dielectric member 12 is slid rearward to hold the distal end portion of the inner terminal 4 (This operation may be carried out at a final step of the end processing operation.).

In the condition of FIG. 22, the press-fastening piece portions 114*b* of the press-clamping portion 114 are press-deformed by the use of the press-fastening apparatus 115 as shown in FIGS. 23 to 25, and by doing so, the width of each of the slits 114*c* is decreased, and also the first insulating sheath portion 10*a* and the second insulating sheath portion 10*b* are supplementally held by the insulating sheath-holding portions 114*d*. As a result, the coaxial connector 2 is completely mounted on the end portion of the coaxial cable 1, thus completing the series of steps of the end processing operation.

In FIGS. 23 to 28, the press-fastening apparatus 115 comprises the press clamping-purpose press-fastening blade 115*a*, and a reception portion 115*b*. Here, the showing of ordinary functions of the press-fastening apparatus 115 is omitted. The press clamping-purpose press-fastening blade 115*a* includes the press-clamping portion guide grooves 115*c* for respectively guiding the press-fastening piece portions 114*b* during the press-fastening process. A width of the press-clamping portion guide groove 115*c* between its opposed side surfaces is tapering in a direction away from the distal end of the press-fastening blade 115*a*. Namely, the width of the press-clamping portion guide groove 115*c* is defined by tapering surfaces 115*d* for press-deforming the press-fastening piece portion 114*b* to decrease the width of the slit 114*c* while guiding the press-fastening piece portion 114*b*.

As described above with reference to FIGS. 16 to 28, in the end processing structure of the invention, the annular projecting braid portion 3, formed at the coaxial cable 1, is fixed so as to be connected to the press-clamping portion 114 of the shielding terminal 5 of the coaxial connector 2. Therefore, as will be appreciated from the foregoing description, in the invention, the end processing operation can be more easily carried out as compared with the conventional structure. And besides, the invention obviates the need for using a metallic sleeve as required in the conventional structure. Therefore, the end processing of the coaxial cable 1 can be effected with a smaller number of the component parts as compared with the conventional structure. Furthermore, in the structure of the invention, the contours of the transverse cross-sections of the insulator 8 and the outer conductor of the coaxial cable 1 are not deformed. Therefore, the high-frequency characteristics can be maintained more satisfactorily as compared with the conventional structure. Furthermore, in the invention, the braid 9, covered with the second insulating sheath portion 10*b*, is not moved because of the structural nature, and therefore the shielding terminal 5, fixed so as to be connected to the annular projecting braid portion 3, can be stably held in position. Therefore, the tensile strength can be maintained more satisfactorily as compared with the conventional structure.

In the invention, various modifications can be made without departing from the subject matter of the invention. For example, there can be provided an end processing structure in which the annular projecting braid portion 3 is not formed, and only a surface portion of the insulating sheath 10 is gripped by the press-clamping portion 114, thereby fixing the coaxial cable 1 to the shielding terminal 5.

In the invention, various modifications can be made without departing from the subject matter of the invention.

What is claimed is:

1. A coaxial cable end-processing structure wherein an intermediate portion of an insulating sheath of a coaxial cable is removed to form first and second insulating sheath portions, and the first insulating sheath portion is drawn toward the second insulating sheath portion, so that a braid is projected into an annular shape outwardly from an interval between opposed ends of said first and second insulating sheath portions to form an annular projecting braid portion;

wherein said annular projecting braid portion is fixed so as to be connected to a portion of a coaxial cable shielding terminal for connection to an end portion of said coaxial cable, said portion of the coaxial cable shield terminal having a slit, defined by adjacent side plates, into which the braid portion is received and retained.

2. A coaxial cable end-processing structure according to claim 1, wherein said portion of said coaxial cable shielding terminal is configured to be fixed so as to be connected by press-contacting to said annular projecting braid portion.

3. A coaxial cable end-processing structure according to claim 1, wherein said annular projecting braid portion is clamped between the side plate portions such that said side plate portions squeeze said annular projecting braid portion in a direction of a thickness thereof.

4. A coaxial cable end-processing structure according to claim 1, wherein said coaxial cable shielding terminal has an insulating sheath-holding portion formed at or in a vicinity of said braid fixing portion, and said insulating sheath-holding portion holds said second insulating sheath portion or both of said first and second insulating sheath portions.

5. A coaxial cable shielding terminal including a braid fixing portion, wherein said braid fixing portion is configured to be fixed so as to be connected by press-contacting or press-clamping to an annular projecting braid portion of a coaxial cable, said annular projecting braid portion being formed by removing an intermediate portion of an insulating sheath of said coaxial cable to form first and second insulating sheath portions and by drawing the first insulating sheath portion toward the second insulating sheath portion, thereby causing a braid to project into an annular shape outwardly from an interval between opposed ends of said first and second insulating sheath portions.

6. A coaxial cable shielding terminal according to claim 5, wherein said coaxial cable shielding terminal has an insulating sheath-holding portion formed at or in a vicinity of said braid fixing portion, and said insulating sheath-holding portion is adapted to hold said second insulating sheath portion or both of said first and second insulating sheath portions.

7. A coaxial cable end-processing structure wherein a slit, extending in a direction generally perpendicular to a direction of extending of a coaxial cable, is formed in a press-clamping portion of a coaxial cable shielding terminal, and said press-clamping portion is press-deformed so as to decrease a width of said slit, thereby causing said slit portion to grip an insulating sheath of said coaxial cable and/or a braid of said coaxial cable exposed to the exterior of said insulating sheath wherein an intermediate portion of said insulating sheath is removed to form first and second insulating sheath portions, and the first insulating sheath portion is drawn toward the second insulating sheath portion, so that said braid is projected into an annular shape outwardly from an interval between opposed ends of said first and second insulating sheath portions to form an annular projecting braid portion, and said annular projecting braid portion is gripped by said slit portion.

8. A coaxial cable shielding terminal having a press-clamping portion, wherein said press-clamping portion has a slit extending in a direction generally perpendicular to a direction of extending of a coaxial cable, and said press-clamping portion can be press-deformed so as to decrease a width of said slit, thereby causing said slit portion to grip an insulating sheath of said coaxial cable and/or a braid of said coaxial cable exposed to the exterior of said insulating sheath wherein an intermediate portion of said insulating sheath is removed to form first and second insulating sheath portions, and the first insulating sheath portion is drawn toward the second insulating sheath portion, so that said braid is projected into an annular shape outwardly from an interval between opposed ends of said first and second insulating sheath portions to form an annular projecting braid portion, and said annular projecting braid portion can be gripped by said slit portion.

* * * * *